United States Patent [19]

Ishiguro et al.

[11] Patent Number: 4,974,823

[45] Date of Patent: Dec. 4, 1990

[54] SORTER-FINISHER WITH A SHEET BINDING FUNCTION AND A METHOD OF OPERATING THEREOF

[75] Inventors: Kuniaki Ishiguro; Takuma Ishikawa, both of Osaka, Japan

[73] Assignee: Minolta Camera Kabushiki Kaisha, Osaka, Japan

[21] Appl. No.: 295,885

[22] Filed: Jan. 11, 1989

[30] Foreign Application Priority Data

Jan. 12, 1988 [JP] Japan ..... 63-5581
Jan. 12, 1988 [JP] Japan ..... 63-5582

[51] Int. Cl.[5] ..... B42B 41/00
[52] U.S. Cl. ..... 270/53; 270/58
[58] Field of Search ..... 270/37, 53, 58; 355/324

[56] References Cited

U.S. PATENT DOCUMENTS

| | | |
|---|---|---|
| 3,386,729 | 6/1968 | Pine . |
| 3,645,615 | 2/1972 | Spear . |
| 3,697,063 | 1/1972 | Greenfield et al. . |
| 3,709,595 | 1/1973 | Turner et al. . |
| 3,944,207 | 3/1976 | Bains . |
| 4,067,649 | 1/1978 | Hubbard et al. . |
| 4,073,391 | 2/1978 | O'Brien et al. . |
| 4,076,408 | 2/1978 | Reid et al. . |
| 4,123,155 | 10/1978 | Hubert . |
| 4,134,672 | 1/1979 | Burlew et al. . |
| 4,145,037 | 3/1979 | Mol . |
| 4,190,246 | 2/1980 | Sasuga . |
| 4,203,587 | 5/1980 | Kishi et al. . |
| 4,218,128 | 8/1980 | Satomi et al. . |
| 4,227,275 | 10/1980 | Söderberg . |
| 4,238,066 | 12/1980 | Brooke . |
| 4,248,413 | 2/1981 | Fox . |
| 4,248,525 | 2/1981 | Sterrett . |
| 4,265,440 | 5/1981 | Shibazaki et al. . |
| 4,272,180 | 6/1981 | Satomi et al. . |
| 4,281,920 | 8/1981 | Cross . |
| 4,295,733 | 10/1981 | Janssen et al. . |
| 4,313,670 | 2/1982 | Caldwell . |
| 4,361,393 | 11/1982 | Noto . |
| 4,365,886 | 12/1982 | Murakami et al. . |
| 4,368,972 | 1/1983 | Naramore . |
| 4,371,155 | 2/1983 | Asterö et al. . |

(List continued on next page.)

FOREIGN PATENT DOCUMENTS

| | | |
|---|---|---|
| 99250 | 1/1984 | European Pat. Off. . |
| 2732673 | 9/1978 | Fed. Rep. of Germany . |
| 3218747 | 12/1982 | Fed. Rep. of Germany . |
| 3701450 | 7/1987 | Fed. Rep. of Germany . |
| 55-15150 | 2/1980 | Japan . |
| 57-72537 | 5/1982 | Japan . |
| 57-131667 | 8/1982 | Japan . |
| 57-203037 | 12/1982 | Japan . |
| 59-43765 | 3/1984 | Japan . |
| 59-177232 | 10/1984 | Japan . |
| 60-183461 | 9/1985 | Japan . |
| 60-248563 | 12/1985 | Japan . |
| 61-72569 | 4/1986 | Japan . |
| 61-26061 | 6/1986 | Japan . |
| 61-145069 | 7/1986 | Japan . |
| 61-261096 | 11/1986 | Japan . |
| 2185465 | 7/1987 | United Kingdom . |

*Primary Examiner*—Edward K. Look
*Assistant Examiner*—Therese M. Newholm
*Attorney, Agent, or Firm*—Burns, Doane, Swecker & Mathis

[57] ABSTRACT

In a sorter-finisher distributing sheets ejected from a copying machine among a plurality of bins and thereafter stapling the distributed sheets, the plurality of bins can move independently from each other within a first area where the sheets are distributed and a second area where the distributed sheets are stapled. Some of the bins among which the sheets are not distributed are continuously moved to said second area without actuating a stapler, and then the other bins among which the sheets are distributed are moved to the second area one by one actuating the stapler. Further, in the sorter-finisher, a finishing mode which allows an operation of the stapler after a distributing process can be selected in the middle of or even after as well as before the distributing process.

4 Claims, 30 Drawing Sheets

U.S. PATENT DOCUMENTS 4,376,529 3/1983 George et al. .
4,385,827 5/1983 Naramore .
4,411,515 10/1983 Kukucka et al. .
4,424,963 1/1984 Bartholet et al. .
4,473,425 9/1984 Baughman et al. .
4,497,478 2/1985 Reschenhofer et al. .
4,515,458 5/1985 Masuda et al. .
4,549,804 10/1985 Braun et al. .
4,564,185 1/1986 Hamlin et al. .
4,566,782 1/1986 Britt et al. .
4,573,789 3/1986 Wada .
4,582,421 4/1986 Hamlin et al. .
4,592,651 6/1986 Oikawa et al. .
4,595,187 6/1986 Bober .
4,603,971 8/1986 Kukucka et al. .
4,626,156 12/1986 Baughman et al. .
4,647,034 3/1987 Sawa .
4,647,188 3/1987 Komiya et al. .
4,674,732 6/1987 Hori .
4,674,866 6/1987 Tanaka .
4,687,191 8/1987 Stemmle .
4,702,589 10/1987 Ito .
4,718,657 1/1988 Otter et al. .
4,721,382 1/1988 Ito et al. .
4,730,206 3/1988 Sawada et al. .
4,743,945 5/1988 Ito et al. .
4,763,889 8/1988 Dei et al. .

SORTER-FINISHER WITH A SHEET BINDING FUNCTION AND A METHOD OF OPERATING THEREOF

FIELD OF THE INVENTION

The present invention relates to a sorter-finisher and a method of operation thereof, more particularly, a sorter-finisher so that sheets having images transcribed by a copying machine can be distributed and bound accordingly after being ejected from the copying machine.

BACKGROUND OF THE INVENTION

Recently, responding to the increasing demand for automated paper handling systems for copying machines, optional systems such as an automatic document feeding system and a sorting system designed for sorting or grouping copied sheets have been developed and commercialized in various types. The users of the copying machines are now requiring a sorter-finisher capable of automatically binding and stacking sheets which have been distributed in the sorting system, and this type of sorter-finisher has already been commercialized for some of large-sized copying machines. Also, a compact sorter having a plurality of bins disposed one upon another, wherein the bins are moved in order from the top bin to the bottom to enlarge the space between the bins so that sheets are distributed among the bins, has been commercialized.

If a sheet binding function is provided for this type of sorter having movable bins, the bins should be moved to a sheet take-out position where sheets are transported into a binding unit orderly from the bottom bin to the top. However, since sheets are distributed into the bins in order from the top, in a stapling process, the bins are moved one by one to the take-out position orderly from the bottom bin which have no sheets therein Accordingly, This type of sorter-finisher has a problem of loss of time.

Also, in using this type of sorter-finisher, when an operator notices the necessity of a stapling process in the middle of a copying operation without selecting a finishing mode in the first place in which a stapling process is executed, the operator should cancel the current copying operation and thereafter select a copying mode again to start another copying operation. This is troublesome and not economical.

SUMMARY OF THE INVENTION

In view of the above-mentioned problems, an object of the present invention is to provide a sorter-finisher and a method of operating thereof with which the bins are moved efficiently without loss of time in the case of a copying operation in the finishing mode where sheets are bound.

Another object of the present invention is to provide a convenient sorter-finisher where the finishing mode can be designated even in the middle of and after the sorting process.

To attain the above-mentioned objects, a sorter-finisher according to the present invention comprises a plurality of bins disposed one after another and movable independently from each other within a first area and a second area which are adjacent vertically to each other; means for distributing sheets ejected from an image forming device among the bins by the movement of the bins within the first area; means for shifting the plurality of bins from the first area to the second area; means for stapling sheets in the bins already shifted to the second area; and a control means for shifting the bins which have no sheets therein to the second area continuously without actuating the stapling means and thereafter shifting the other bins which have distributed sheets therein to the second area one by one with the operation of the stapling means.

A method of operating a sorter-finisher according to the present invention comprises distributing sheets ejected from an image forming device among some of a plurality of bins while the bins are moving within a first area; shifting the bins which have no sheets therein continuously to a second area from a first area where sheets are distributed without actuating a stapling means; and thereafter shifting the other bins which have distributed sheets therein to the second area one by one with the operation of the stapling means.

With the sorter-finisher as constructed above and the method of operating thereof described above, sheets ejected from the image forming device are distributed among the plurality of bins, and thereafter the distributed sheets are stapled. More specifically, when the finishing mode wherein a stapling process is executed is designated, sheets are distributed among some of bins from the top according to the inputted number of copy sets to be made by an operator. After the distributing process, first the bins which have no sheets therein are moved continuously to the second area, and next the bins which have distributed sheets therein are moved to the second area one by one to execute a stapling process. Therefore, the stapling process is started with the bottom bins of those which have sheets therein, and this solves the problem of loss of time.

Further, a sorter-finisher according to the present invention comprises means for selecting a finishing mode which allows an operation of the stapling means; a first control means for starting an operation of the stapling means in response to the order to execute a finishing process when the finishing mode is designated; and a second control means for allowing an operation of the mode selecting means before a distributing process, in the middle of the distributing process and preferably after the distributing process.

With the sorter-finisher as constructed above, sheets ejected from the image forming device are distributed among the plurality of bins, and thereafter the distributed sheets are stapled. Even in the middle of a copying operation without designating the finishing mode, if sheets are distributed among the bins, there is no problem to proceed to a stapling process. Selecting the finishing mode by the mode selecting means is accepted even in the middle of a distributing process and after the distributing process. Therefore, this can be solve the trouble of starting another image forming operation after selecting the finishing mode.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENT

An embodiment of the present invention will be described below with reference to the drawings.

(Composition of whole system)

Figure 1:
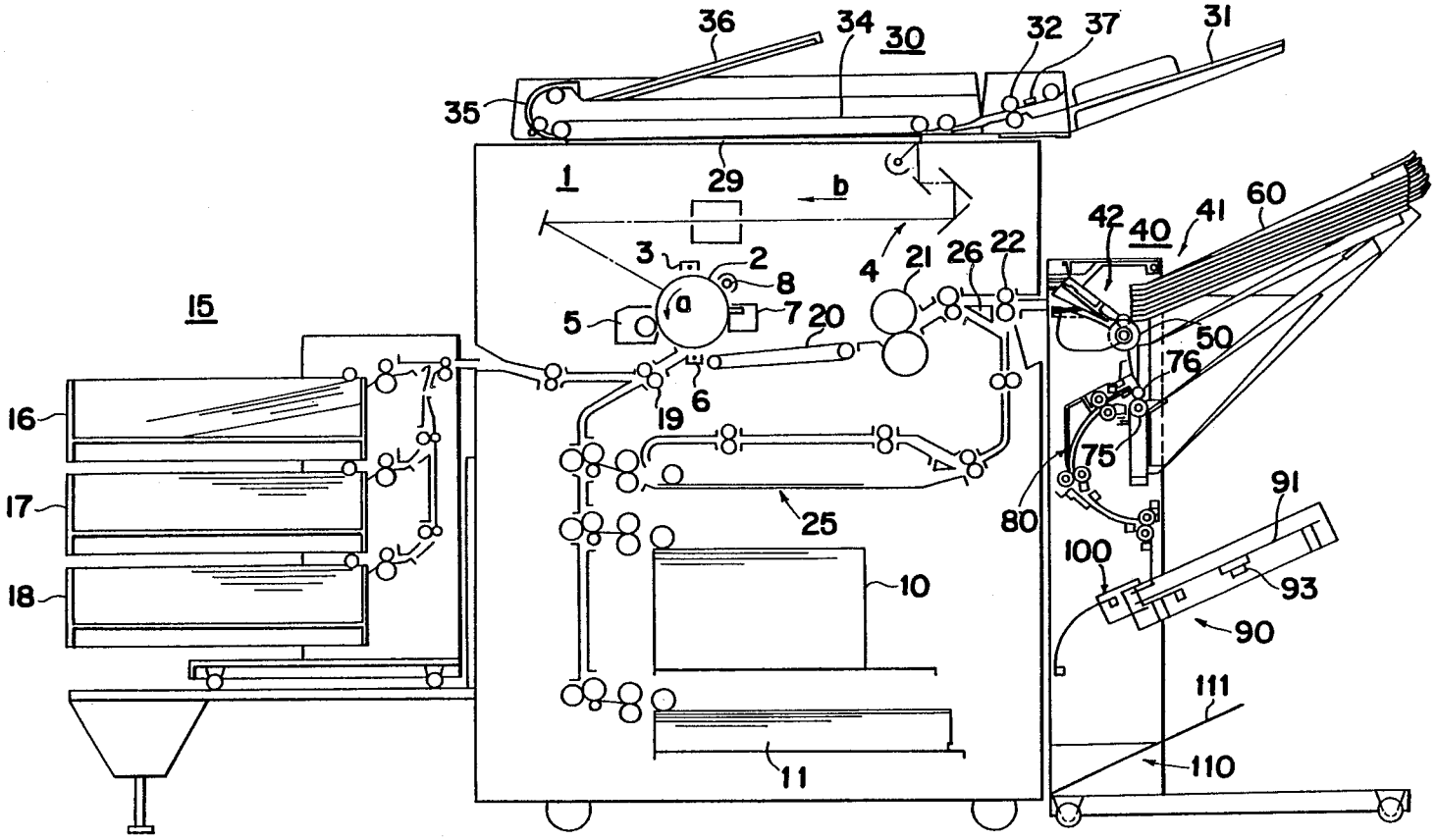
FIG. 1 is a schematic block diagram showing a copying machine and a sorter-finisher.

A sorter-finisher 40 is designed to be installed on the side of a copying machine 1 as shown in FIG. 1, and the copying machine 1 is provided with an automatic paper feeding unit 15 and an automatic document feeding unit 30 (hereinafter referred to as ADF).

The copying machine 1 operates on the principle of the commonly known electro-photography. In this copying machine 1, a photosensitive drum 2 to be turned in the direction of an arrow a is charged with a certain amount of static electricity by a static electricity charger 3, and the document set to a specified position by the ADF 30 is exposed to the light through a slit when an optical system 4 scans the document in the direction of an arrow b. This causes the electrostatic latent image formed on the photosensitive drum 2 to be developed into a toner image by a magnetic brush type developing device 5 and then transferred onto a sheet by a transfer charger 6.

Copying sheets are fed one by one selectively from an elevator type and a cassette type automatic paper feeders 10 and 11 built in the copying machine 1 or the 3-stage paper feed cassettes 16, 17 and 18 of the automatic paper feeder 15 installed outside the copying machine 1, and each of the sheets is transported to a transferring portion by a pair of timing rollers 19 with specified timing. The sheet carrying an original image is delivered to a fixing unit 21 by a conveyor belt 20 for fixing the toner image. Then, the sheet is transported to a sorting unit 41 by a pair of ejection rollers 22 while the passage of the sheet is detected by an ejection switch SW3 (Refer to FIG. 2) provided immediately before the pair of ejection rollers 22. The copying machine 1 has a built-in paper refeeder 25, which enables duplex copying and composite copying, and a sheet transport selection click 26 is provided before the pair of ejection rollers 22.

On the other hand, the photosensitive drum 2 is continued to turn in the direction of the arrow a even after the toner image is transferred so that the residual toner can be removed by a blade-type cleaner 7, and simultaneously the residual electrostatic charge is erased by an eraser lamp 8 in order to prepare for the next copying operation.

The ADF 30 itself is commonly known and designed to feed documents placed on a document tray 31 one by one using a pair of feed rollers 32 and to set them to a specified position on a glass member 29 of a document rest by the rotary motion of a conveyor belt 34. After the exposure of the document image, the document is ejected onto an ejection tray 36 through a transfer pass 35 as the conveyor belt 34 turns.

Figure 2:
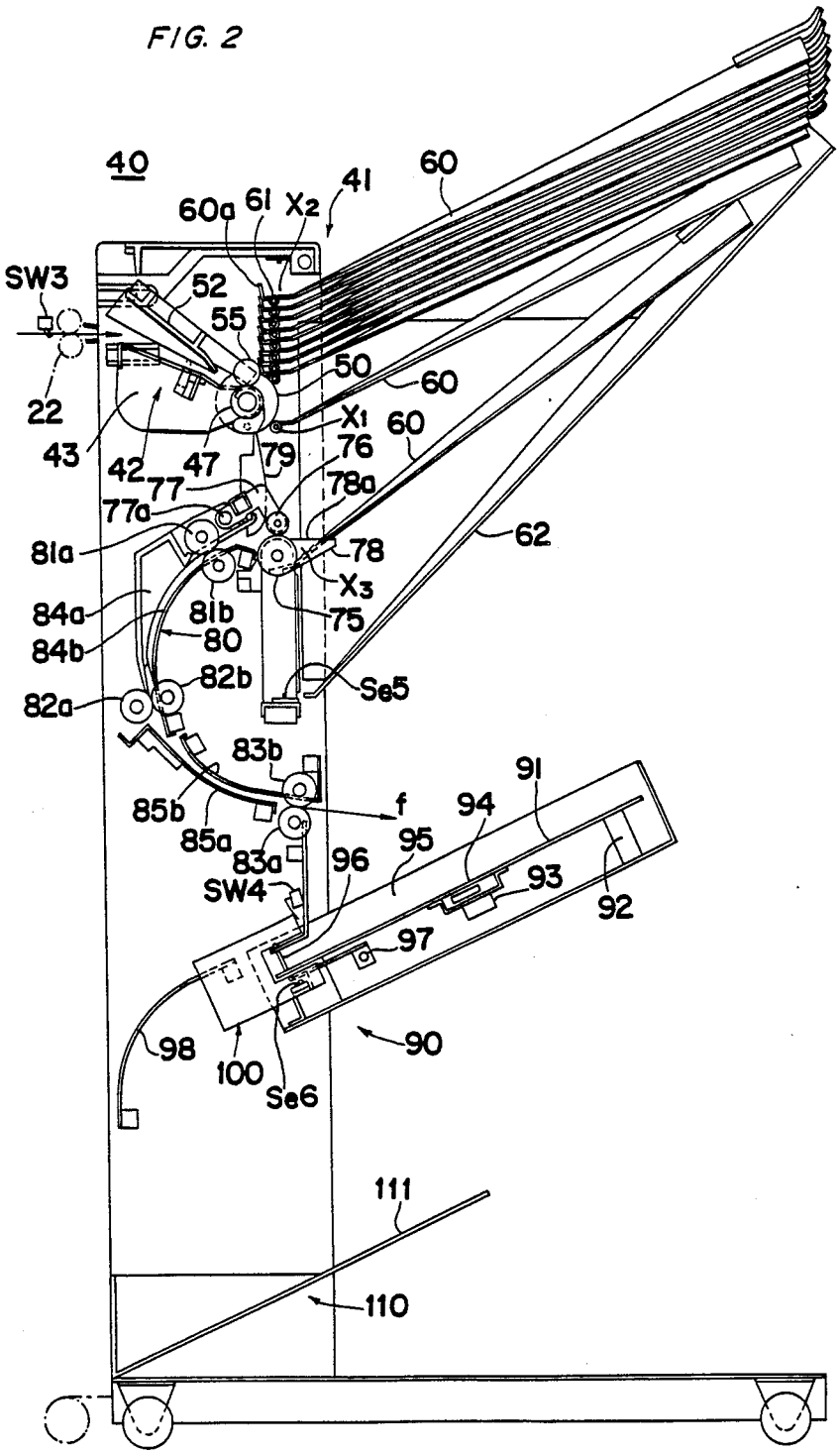
FIG. 2 is an internal composition of the sorter-finisher.

As shown in FIG. 2, the sorter-finisher 40 comprises a sorting unit 41 for distributing sheets among bins 60, a stapling unit 90 with a stapler 100 for stapling the sheets and a stacking unit 110 for stacking the stapled sheets. In this sorter-finisher 40, the stapling unit 90 is disposed below the sorting unit 41, and the stacking unit 110 is disposed below the stapling unit 90.

(Composition and operation of the sorting unit)

Figure 3:
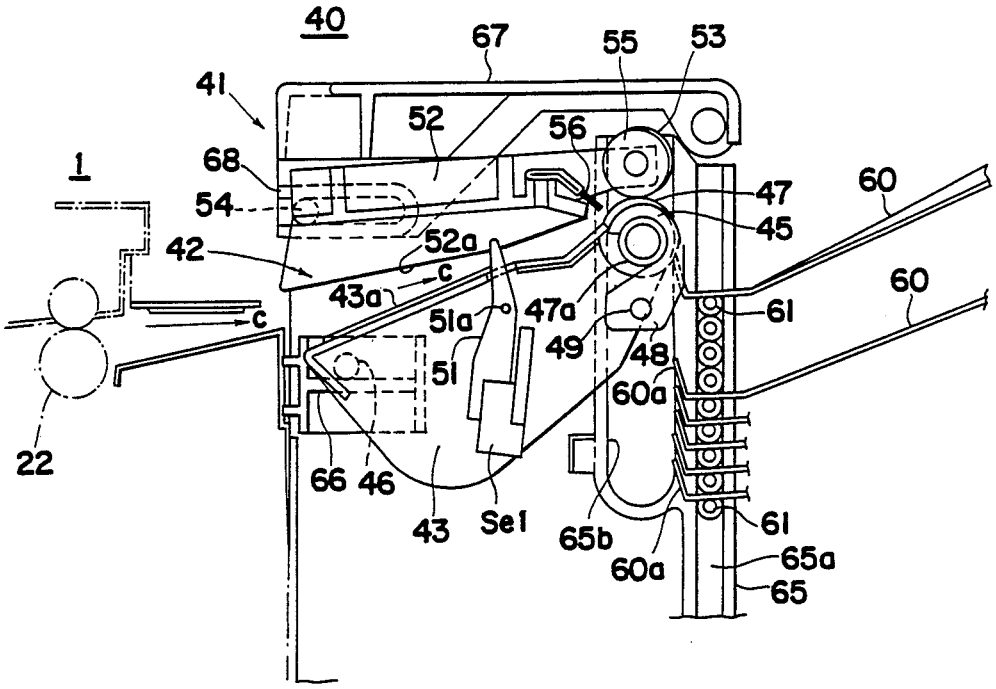
FIG. 3 is an internal composition of a sorting unit.
Figure 8:
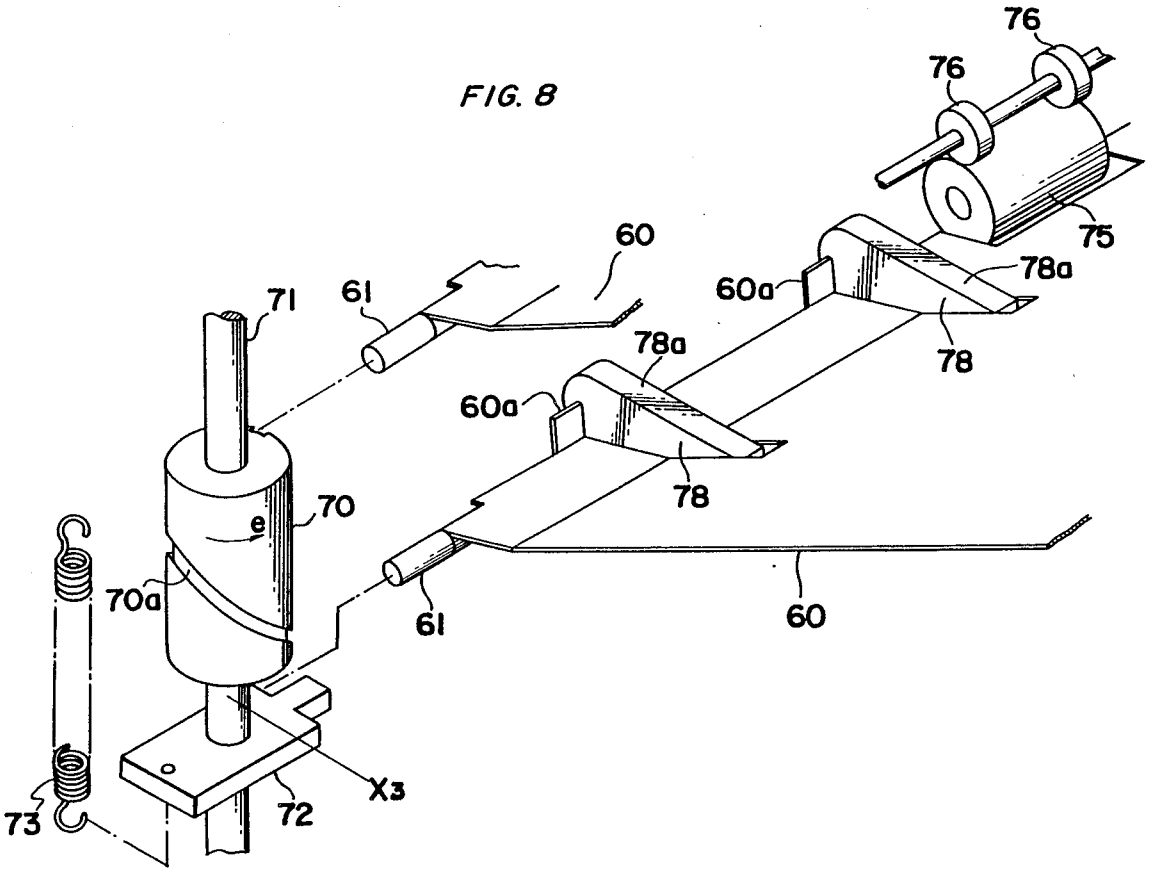
FIG. 8 is a perspective view of a sheet take-out position.
Figure 9:
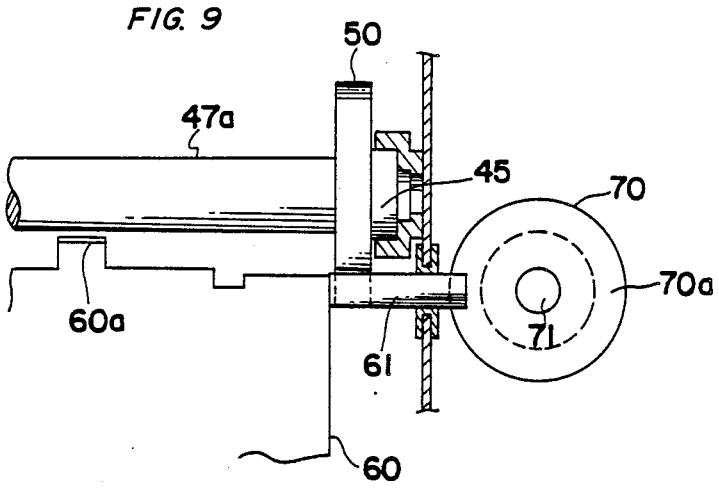
FIG. 9 is a plan view showing a mechanical relationship of a trunnion and the fixed cam.

As shown in FIGS. 2, 3 and 8, a plurality of tabs 60*a* for preventing the reverse flow of sheets and a pair of trunnions 61 are provided on one end of each of the bins 60. The trunnions 61 engage with a groove 65*a* extending longitudinally along a pair of guide units 65 (only one is shown in FIG. 3 ) installed on a frame of the sorter-finisher 40 in order to regulate the movements of the bins 60 along the longitudinal direction. The other end of each of the bins 60 is supported by a bin holder 62. Floating cams 50, which will be explained later, shift the position of the trunnions 61 so that the intervals of the bins 60 can be increased.

The sorting unit 41 distributes the sheets ejected from the copying machine 1 with the relative upward and downward movement of a sheet transport unit 42 disposed opposite the pair of ejection rollers 22 of the copying machine 1 and that of the bins 60. As shown in FIG. 3, the sheet transport unit 42 comprises an upper unit 52 having a guiding surface 52*a*, a lower unit 43 having a guiding surface 43*a*, a feed roller 47 and a pinch roller 55 so that the sheet from the rollers 47 and 55 is transported to each bin 60 passing between the guiding surfaces 52*a* and 43*a*.

Figure 4:
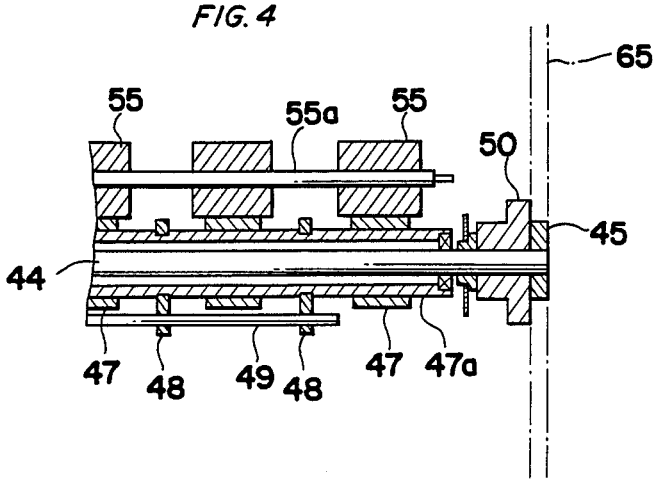
FIG. 4 is a horizontal cross-sectional view of a feed roller section of the sorting unit.
Figure 5:
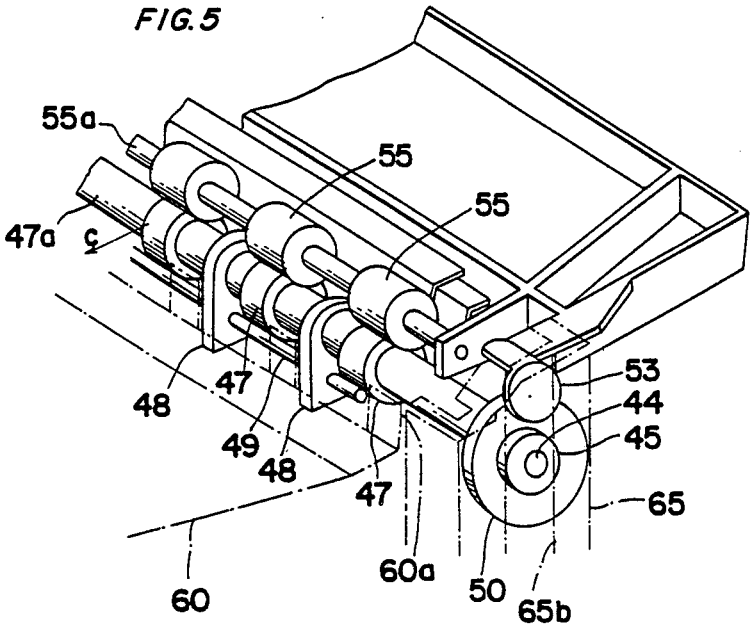
FIG. 5 is a perspective view of a conveyance unit.
Figure 6:
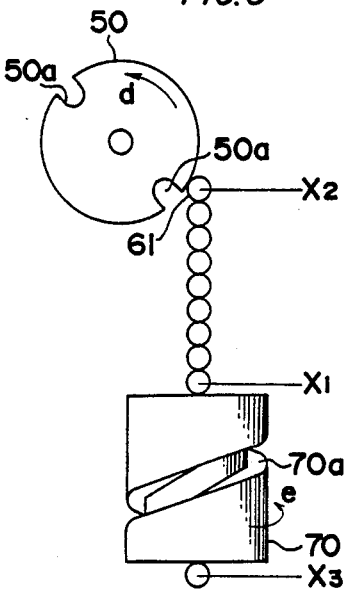
FIG. 6 is an explanatory drawing of a floating cam and a fixed cam.
Figure 7:
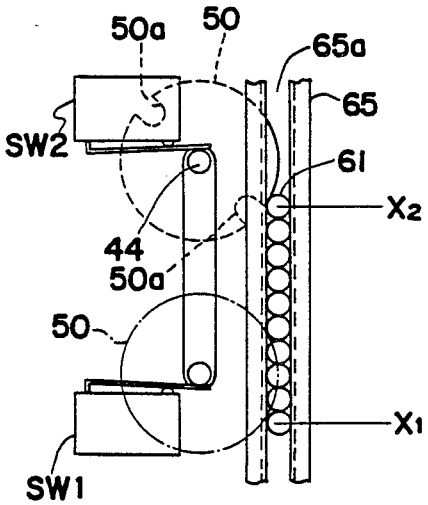
FIG. 7 is an explanatory drawing of the floating cam.

One end of the lower unit 43 is supported by a supporting shaft 44 which is disposed on the side of the bins 60 orthogonally to the direction of the travel of sheets indicated by an arrow c, and the other end of the lower unit 43 has a pin 46 which is supported slidably on a guide member 66. Both ends of the shaft 44 engage with a rail unit 65*b* installed on the guide unit 65 through a collar 45 as shown in FIGS. 4 and 5, so that the lower unit 43 can shake vertically using the pin 46 as a fulcrum and that it can also slide horizontally on the guide member 66. A roller shaft 47*a* upon which a plural number of feed rollers 47 are fixed is installed on the supporting shaft 44 in a manner to permit the free rotation of the roller shaft 47*a*, and oscillating plates 48 are connected to each other by a rod 49, and the lower part of the oscillating plates 48 are located between the reverse flow prevention tabs 60*a* of the bins 60. Besides, as shown in FIGS. 6 and 7, the floating cams 50 with notches 50*a*, which are formed on the circumferential surface at intervals of 180°, are fixed to both ends of the supporting shaft 44. These floating cams 50 are turned 180° intermittently by the different driving source from that of the feed rollers 47 and support not only the lower unit 43 but also the rear ends of bins 60 by means of the trunnions 61 which come to contact their circumferential surface. Furthermore, as shown in FIG. 7, each floating cam 50 can move up and down between a bottom bin position X1 and a top bin position X2, and the cam 50 can be detected by detection switches SW1 and SW2 when it has reached these positions X1 and X2. As shown in FIG. 3, the lower unit 43 is provided with an actuator 51 which turns freely round a pin 51*a* and a photosensor Se1 which can be turned on and off when the actuator 51 turns keeping in contact with the sheet to be transported.

One end of the upper unit 52 has an engaging piece 53 which engages with the rail unit 65*b*, and the other end of the upper unit 52 has a pin 54 which engages with a guide member 68 provided for a top cover 67 of the sorter 40. Then, upper unit 52 can shake vertically using the pin 54 as a fulcrum and can also slide horizontally. Pinch rollers 55 are installed pivotally to the upper unit 52 through a supporting shaft 55*a*. Also, a neutralizing brush 56 is installed to the upper unit 52. The pinch rollers 55 press the feed rollers 47 utilizing their own weight can be driven by the feed rollers 47.

A transmission type photosensor Se5 (Refer to FIG. 2) whose optical axis is located at the rear end of each bin 60 is installed in the sorting unit 41 so that the presence or the absence of the sheets distributed among and in the bins 60 can be detected.

In the above-described composition, the trunnion 61 which is in contact with the circumference of the floating cam 50 is introduced into the notch 50*a* by every 180° turn in the direction reverse to the direction of an arrow d, thereby not only causing the floating cam 50 to move upward but also causing the introduced trunnion 61 to shift downward to contact the next trunnion 61. Repeating this action causes each bin 60 to shift downward by one step, while the transport unit 42 moves upward. When the sorting mode is selected, the floating cam 50 is located at the top bin position X2 as shown in FIG. 7, and this cam 50 increases the intervals of the bins 60 as it moves downward step by step rom this position. The sheets ejected from the copying machine 1 pass between the guiding surfaces 52*a* and 43*a* and between the feed rollers 47 and the pinch rollers 55, and thus the sheets are distributed into the bins 60 in order from the top bin, whose intervals are widened by the floating cam 50. Turning the floating cam 50 in the direction reverse to the arrow d causes the bins 60 to shift downward one by one, and the cam 50 moves upward together with the transport unit 42.

In the sorting unit 41 having the above-described composition, the sheets can be stored in three different modes. The first mode is the sorting mode to enable the sheet formed each document image on to be distributed among the bins 60 and sorted in the order of page number. The second mode is the grouping mode to enable the sheets formed the same image on to be distributed among the same bins 60. The third mode is the non-sorting mode to enable the sheets to be stored (not to be distributed) only in one bin 60.

(Construction and operation of the fixed cam)

Here, the explanation will be made as to fixed cams 70 and a transport unit 80 which are used for transporting the sheets distributed among the bins 60 to a staple tray 91 which will also be explained in the following.

As shown in FIGS. 6 and 8, each fixed cam 70 has a spiral groove 70*a* turning once round the circumferential area of the fixed cam 70 for enabling the engagement of the trunnion 61 and the groove 70*a*, and the fixed cam 70 can be turned in both the normal direction and the reverse direction by a motor not shown in the drawings. That is, the fixed cam 70 turns in the normal direction or the direction of an arrow e to lower the trunnion 61 of each of the bins 60, which has been shifted to the bottom bin position X1 by the floating cam 50, to a sheet take-out position X3.

On the other hand, as shown in FIG. 8, at the sheet take-out position X3, a receiving member 72 installed to a supporting shaft 71 is hooked by a coil spring 73 and can move up and down along the supporting shaft 7!. The trunnion 61 descended to the take-out position X3 is received by the receiving member 72 and is supported with elasticity of the coil spring 73. The take-out position X3 is provided with a take-out roller 75, pinch rollers 76 which are pressed against the roller 75 in accordance with their weight and sheet guides 78. Also, as shown in FIG. 2, a sheet reverse flow prevention guide 79 is installed between the bottom bin position X1 and the take-out position X3. As shown in FIG. 8, each sheet guide 78 is installed in the way that a guiding surface 78*a* on the top of the sheet guide 78 comes a little above the position of the sheet reverse flow prevention tabs 60*a* of each bin 60 which has descended to the take-out position X3 by increasing the angle of its inclination. As shown in FIG. 2, the pinch rollers 76, which are supported by a shaft 77*a* and an arm 77, can rotate around the shaft 77, and they are kept in contact with or retracted from the roller 75 by a solenoid not shown in the drawings.

Figure 10:
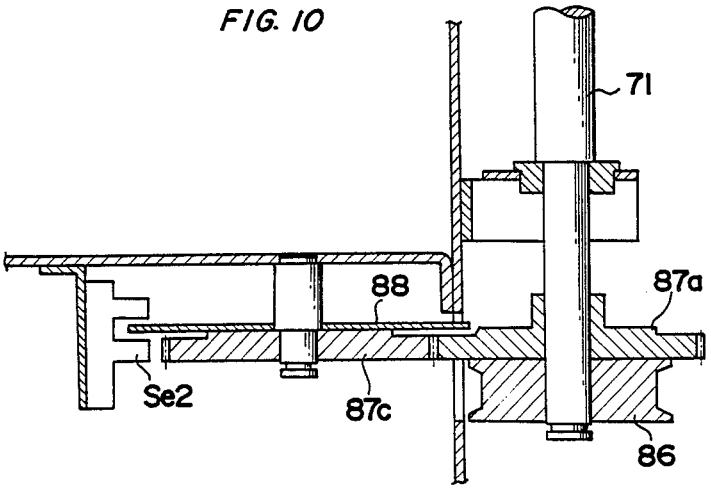
FIG. 10 is a vertical cross-sectional view showing a rotary detector of the fixed cam.

Furthermore, as shown in FIG. 10, a driving pulley 86 and a gear 87*a* are integrally fixed to the lower end of the supporting shaft 71 of the fixed cam 70. The gear 87*a* engages with a gear 87*c*. A disk 88 integrally fixed to the gear 87*c* has a notch not shown in the drawings which is detected by a photosensor Se2 in order to control the number of revolutions of the fixed cam 70.

As shown in FIG. 2, the transport unit 80 comprises transport rollers 81*a*, 81*b*, 82*a*, 82*b*, 83*a* and 83*b*, and guide plates 84*a*, 84*b*, 85*a* and 85*b*. The transport rollers 81*a*, 82*a* and 83*a* are made of rubber material, while the rollers 81*b*, 82*b* and 83*b* are made of spongy material so that they are able to transport the various thickness of stacked sheets.

In the above-described arrangement, the fixed cam 70 is turned once in the direction of the arrow e after the sorting unit 41 has completed the distribution of sheets. The trunnion 61 of each of the bins 60 at the bottom bin position X1 is guided by the spiral groove 70*a* to come down to the take-out position X3 where the trunnion 61 is supported by the receiving member 72. At this take-out position X3, the bin 60 inclines at a larger angle than it does at the bottom bin position X1 so that the sheets distributed and stored slide down on the guiding surfaces 78*a* of the guides 78 due to their own weight. The take-out roller 75 overlaps with the bin 60 so that the end of the sheets are caught between the rollers 75 and 76 when the bin 60 has reached the take-out position X3, and then the sheets are transported to the transport rollers 81*a* and 81*b* by the rollers 75 and 76. Even when the sheets are curled downward, the sheets can be transported between the guide plates 84*a* and 84*b* without fail guided by the guides 78 and the take-out roller 75. Also, even when the sheets are curled upward, the sheets are transported between the guide plates 84*a* and 84*b* guided by the reverse flow prevention guide 79.

When the sheets are transported by the rollers 81*a* and 81*b*, the solenoid not shown in the drawings is turned off (wherein it gets back to an initial state) so that the pinch rollers 76 are moved upward away from the top of the take-out roller 75. When the bin 60 has reached the take-out position X3, the solenoid is turned on to nip the sheets between the pinch rollers 76 and the take-out roller 75. At that time, the take-out roller 75 and the transport rollers 81*a* , 81*b*, 82*a*, 82*b*, 83*a* and 83*b* are driven to turn respectively, and then the sheets are transported onto the staple tray 91 through the transport rollers 83*a* and 83*b* as indicated by an arrow 5 in FIG. 2.

In this embodiment, in order to increase the inclination angle of each of the bins 60 at the take-out position X3 to facilitate the sheets on the bins 60 sliding downward by their own weight, the interval between the bottom bin position X1 and the take-out position X3, that is, the stroke of the bins 60 between these two points can be made relatively large.

As explained in the foregoing, the fixed cam 70 turns once respectively, the bins 60 are brought down step by step to the take-out position X3, and the sheets distributed among the bins 60 are transported onto the staple tray 91 by the transport unit 80.

Each of the bins 60 brought down to the take-out position X3 is supported by the receiving member 72. And the bin 60 returns to its upward original position by the rotation of the fixed cam 70 in the direction reverse to the arrow e, and the floating cam 50 in its normal direction or the direction of the arrow d after all the sheets distributed among the bins 60 are taken out.

(Construction and operation of the stapling unit)

As shown in FIG. 2, the stapling unit 90 comprises the staple tray 91, a motor to vibrate the staple tray 91, an upper guide plate 92, a stopper 96 and a stapler 100. The staple tray 91 is oscillatably installed on the supporting shaft 92 to serve as a supporting point, and the staple tray 91 is vibrated by the centrifugal force of an eccentric weight 94 turned by the motor 93. This vibration causes the sheets transported from the transport unit 80 to be regulated by the guide plate 95 and the stopper 96.

Figure 11:
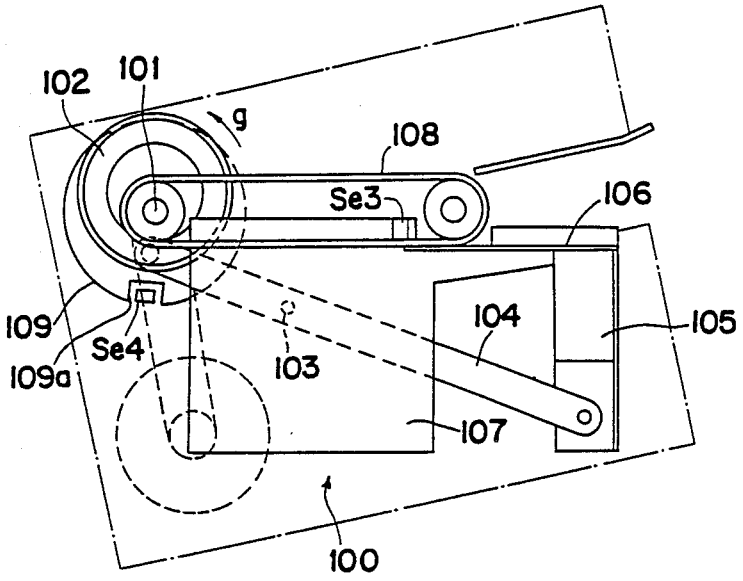
FIG. 11 is a plan view of a stapler.

As shown in FIG. 11, the stapler 100 comprises a fixed output shaft 101 of a motor, an oscillating arm 104 on a pin 103 to serve as a supporting point and a cam 102 whose circumferential part is connected to a head 105 so that the rotation of the cam 102 in the direction of an arrow g by the motor causes the head 105 to move upward through the arm 104, and a staple 106 binds the sheets trued up on the staple tray 91. The staples 106 are contained in a cartridge 107 and transported to the head 105 by a conveyor belt 108 which is driven to turn by the output shaft 101 of the motor.

The stopper 96 is installed on a supporting shaft 97 to serve as a supporting point so that the stopper 96 can be turned by a solenoid not shown in the drawings. The stopper 96 is normally located on the lower end of the staple tray 91 to determine the end position of the sheets. When the solenoid is turned on, the stopper 96 retreats downward to cancel the sheet positioning.

The stapler 100 is provided with a photosensor Se3 for detecting the absence of the staples 106 and a photosensor Se4 for detecting the number of revolutions of the staple motor, that is, the sensor Se3 directly detects the staples 106, while the sensor Se4 detects a notch 109*a* of a disk 109 fixed to the output shaft 101 of the motor.

Furthermore, the stapling unit 90 is provided with a photosensor Se6 for detecting the presence or the absence of the sheets on the staple tray 91 and a switch SW4 for detecting the mounting or the dismounting of the stapler 100.

In the above-described arrangement, the staple tray 91 is vibrated by the revolution of the motor 93, and the vibration of the tray 91 causes the sheets transported from the transport unit 80 onto the staple tray 91 to be aligned by the guide plate 95 and the stopper 96. When the motor 93 stops, the staple motor is driven to staple the sheets. When the solenoid is turned on to withdraw the stopper 96 from the tray 91, the stapled sheets slide down onto a stack tray 111 by being guided by a plate 98. Such stapling operation is repeated each time the bins 60 are moved down to the take-out position X3 by the fixed cams 70 so that the sheets in the bins 60 are carried onto the staple tray 91.

The emptiness of the staples 106 is not necessarily required to be detected only by the sensor Se3. That is, at the time of the stapling operation, the emptiness of the staples 106 can also be detected by the sensor Se4, since the number of revolutions of the staple motor increases when the torque needed for rotating the cam 102 has decreased due to the emptiness of the staples 106. Thus, the increase in the number of revolutions of the staple motor indicates the absence of the staples 106.

(Construction of the stack unit)

Figure 12:
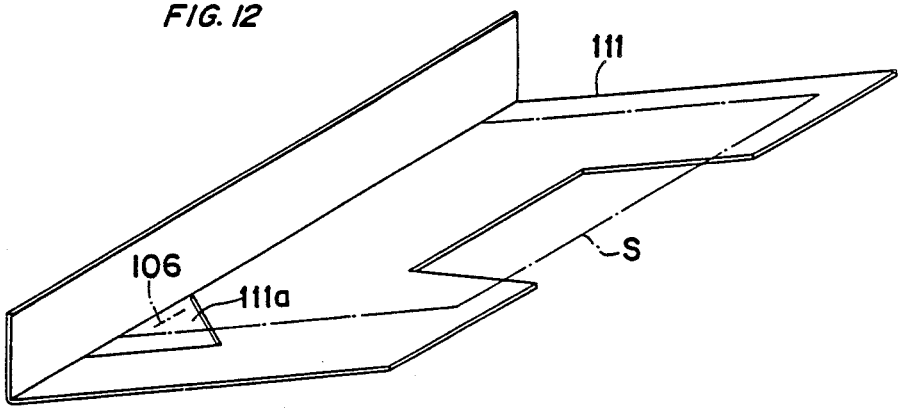
FIG. 12 is a perspective view of a stack tray.

The stack unit 110 comprises the stack tray 111 which is designed for finally containing the sheets stapled by the stapler 100. On the reverse side of the stack tray 111, a reflective photosensor not shown in the drawings is provided so as to detect the presence or the absence of the sheets on the tray 111. As shown in FIG. 12, a notch 111*a* is formed in the part of the stack tray 111 whereon the stapled parts of sheets are piled. Then, the sheets stapled with the stapler 100 and placed on the tray 111 hangs down into the notch 111*a* by their own weight, whereby not only the stapled parts of sheets can be prevented from becoming higher than the nonstapled parts when they are stacked but also the stacking capacity of the stack tray 111 can be increased.

Figure 13:
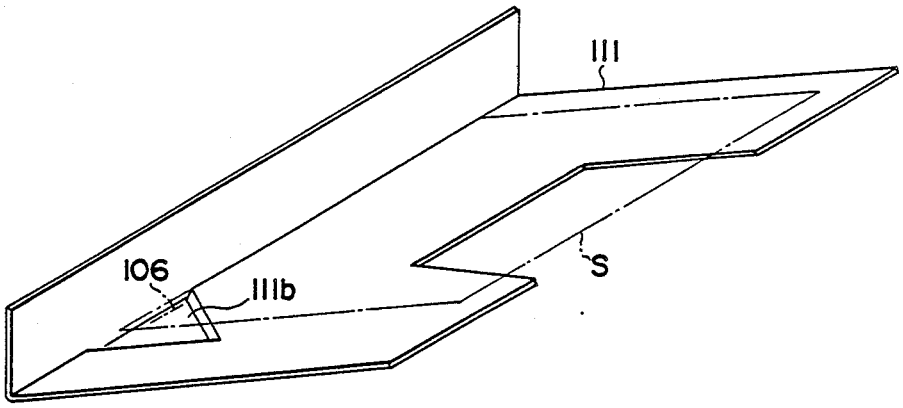
FIG. 13 is a perspective view showing another example of the stack tray.

The similar effect can also be achieved when an indent 111b is formed in the part of the stack tray 111 where the parts of the sheets stapled with staples 106 are stacked as shown in FIG. 13.

(Operation panels)

Figure 14:
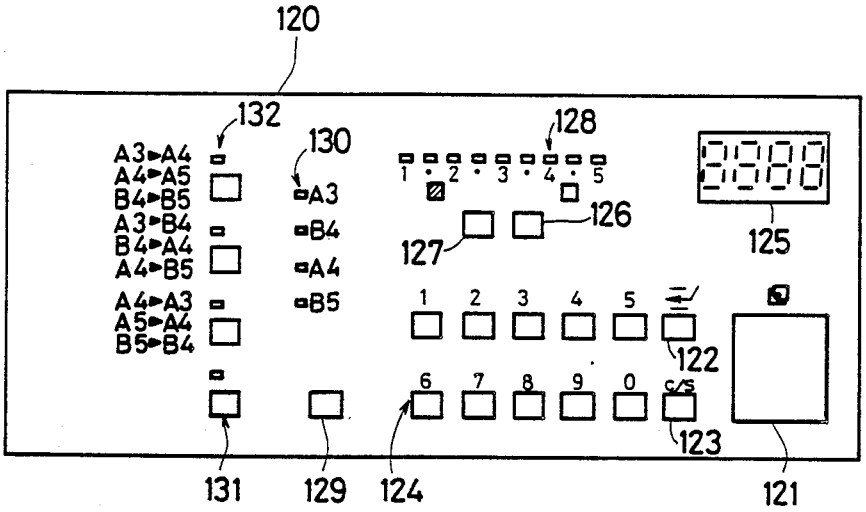
FIG. 14 is a plan view showing an operation panel of the copying machine.
Figure 15:
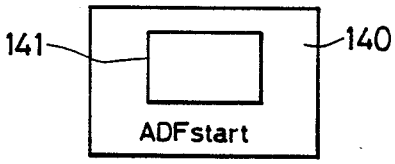
FIG. 15 is a plan view showing an operation panel of an automatic document feeder.
Figure 16:
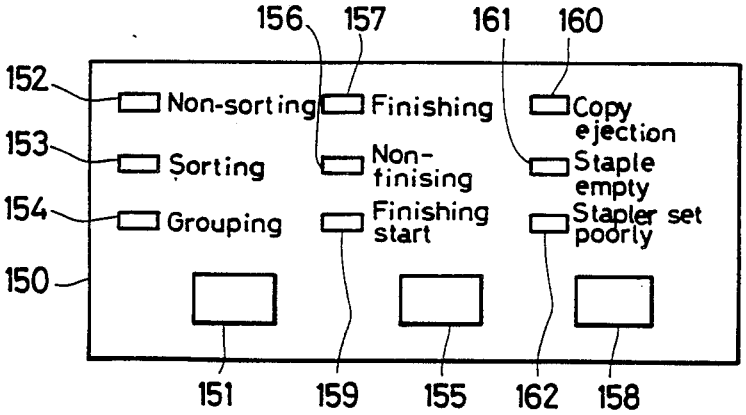
FIG. 16 is a plan view showing an operation panel of the sorter-finisher.

In this embodiment, operation panels are installed at three places, a copying machine panel 120, an ADF panel 140 and a sorter panel 150 as shown in FIGS. 14, 15 and 16 respectively.

A print key 121 for starting the copying operation when ADF 30 is not used, an interruption key 122 for interrupting the multicopying operation temporarily, a clear/stop key 123 for stopping the copying operation or canceling the inputted number of copy sets, a ten key group 124 for setting the number of copy sets, an indicator 125 for indicating the number of copy sets and the condition of the copying machine 1, up/down keys 126 and 127 for setting the density for copy image, LEDs 128 for indicating the density for copy image, a sheet selection key 129 for selecting the sheet size, LEDs 130 for indicating said sizes, a magnification selection key group 131 for selecting the copying magnification and an LED group 132 for indicating said magnifications are installed on the copying machine panel 120.

Only a start key 141 for starting the ADF 30 is installed on the ADF panel 140. When this start key 141 is turned on, the documents on the document tray 31 are automatically transported one by one onto the glass 29 of the document rest, and the copying operation is started.

A sorter mode selection key 151, a non-sorting mode indication LED 15Z, a sorting mode indication LED 153 and a grouping mode indication LED 154 which are the indicators of the sorter mode selection key 151, a finishing mode selection key 155, a non-finishing mode indication LED 156 and a finishing mode indication LED 157 which are the indicators of the finishing mode selection key 155, a finishing start key 158 and an LED 159 as the indicator for the finishing start key 158 are installed on the sorter panel 150. The LED 159, when it is lighted, indicates that the finishing operation is in progress, and when it is flicking, alarms for the necessity of removing the sheets from the staple tray 91. An LED 160 alarms for requiring the necessity of removing the sheets from bins 60, an LED 161 alarms for indicating that the staples 106 are absent and an LED 162 alarms for indicating the poor setting of stapler 100.

The sorter mode selection key 151 selects the modes in the order of non-sorting mode, sorting mode and grouping mode when the key 151 is depressed in succession, and the corresponding LEDs 152, 153 and 154 are lighted accordingly. The finishing mode selection key 155 also selects the modes in the order of non-finishing mode and finishing mode when the key 155 is depressed in succession, and the corresponding LEDs 156 and 157 are lighted accordingly. The finishing start key 158 outputs the signals in the order of the signal for the start of finishing operation and the signal for its cancellation when the key 158 is depressed in succession, and the LED 159 lights when the key 158 is depressed for the start of finishing operation.

(Control circuit)

Figure 17:
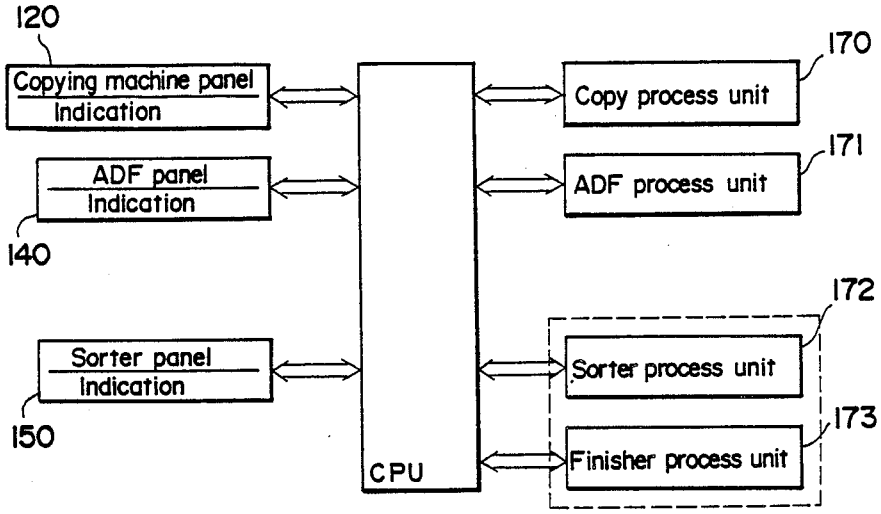
FIG. 17 is a block diagram showing a control circuit.

FIG. 17 is a block diagram of the control circuit wherein a microcomputer is connected to the copying machine panel 120, the ADF panel 140, the sorter panel 150, a copy processing unit 170, an ADF processing unit 171, a sorter processing unit 172 and a finisher processing unit 173 so that the signals can be exchanged with each other.

Figure 18:
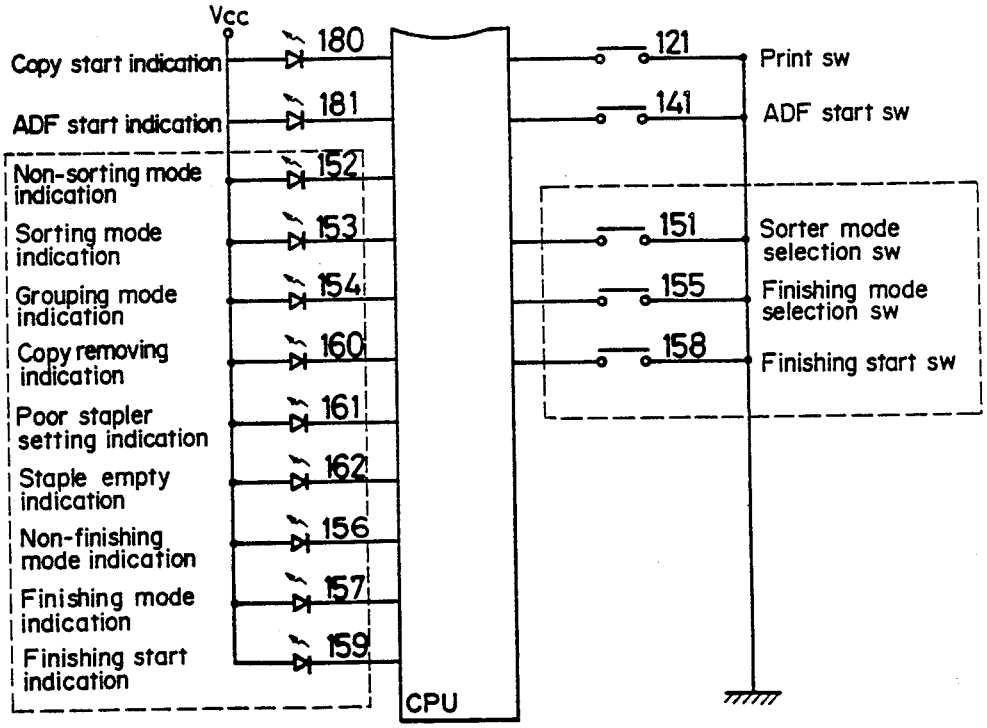
FIG. 18 is details of the control circuit.

FIG. 18 shows the essential part of the control circuit wherein the input/output port of the microcomputer is connected to the print switch 121, the ADF start switch 141 and their built-in indicator LEDs 180 and 181, various selection switches of the sorter panel 150, various indicator LEDs.

(Control procedure)

Here, the control procedures of the copying machine 1 and the sorter-finisher 40 based on the control circuit will be explained in reference to the drawings subsequent to FIG. 19.

In the following paragraphs, the term "on-edge" is defined as change in status, where the switch, sensor, signal or the like changes from the off status to the on status. In contrast, the term "off-edge" represents change in status, where the switch, sensor, signal or the like changes from the on status to the off status.

Figure 19:
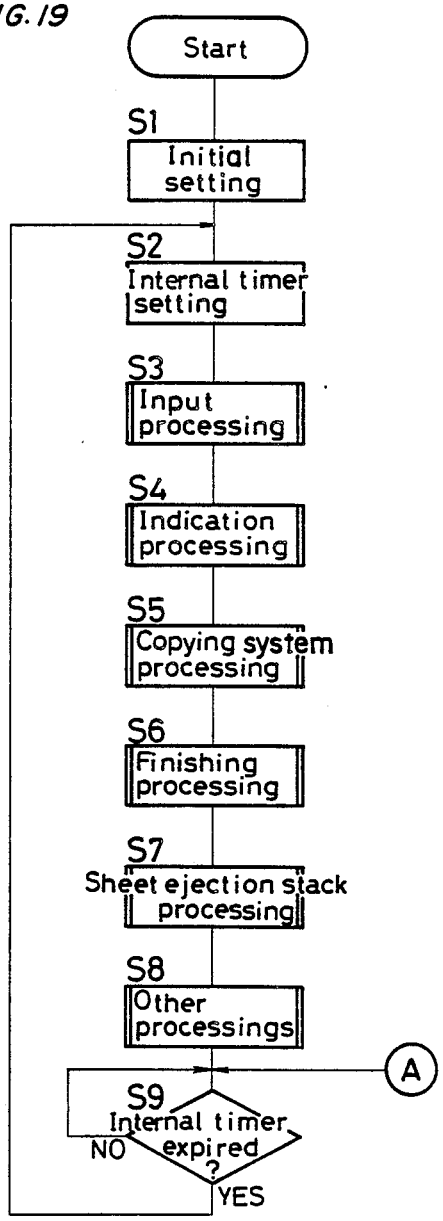
FIG. 19 is a flow chart showing a main routine of a CPU.

FIG. 19 shows a main routine of the microcomputer.

When the microcomputer is reset, and the program is started, the clearance of random access memory at step S1 and the initialization (or the setting for initial mode) of various registers and units take place. An internal timer starts at step S2. The internal timer is for setting the time required for the execution of the main routine, which is to be set in advance at the time of initialization at step S1.

Various subroutines, which will be explained later, are called one by one at steps S3 through S8. When the execution of all the subroutines are completed, the processing returns to step S2 after the time set by the internal timer has passed at step S9. The length of time required for one routine is used in making various counting with various counters during the execution of the subroutines.

Figure 20A:
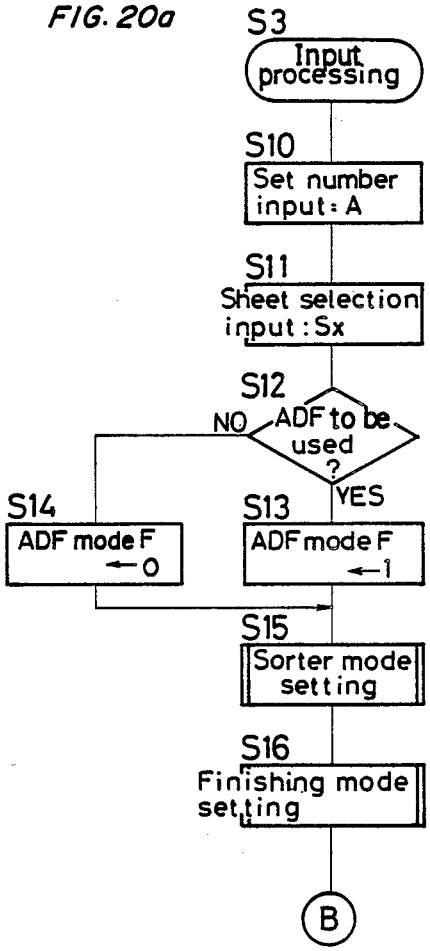
FIGS. 20*a* and 20*b* are flow charts showing a subroutine for the input processing.
Figure 20B:
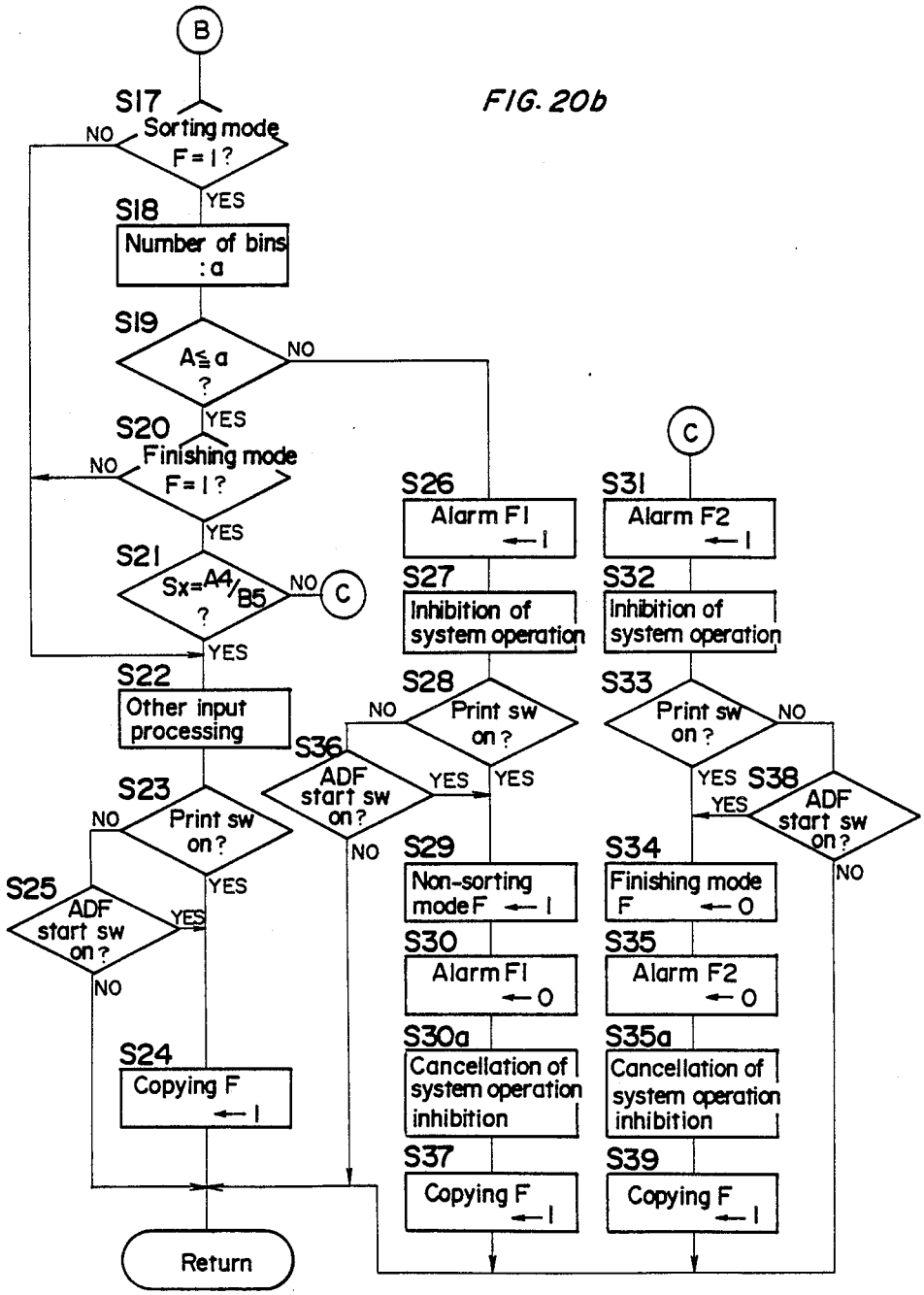

FIGS. 20a and 20b show a subroutine for the input processing to be executed at step S3 of the main routine.

First, a set number (A) is inputted with the ten key group 124 on the copying machine panel 120 at step S10. Then, the sheet size (Sx) selected is inputted at step S11, and whether the ADF 30 has been selected for use is checked at step S12. When the ADF 30 has been selected for use, an ADF mode flag is set to "1" at step S13, and when not selected, the ADF mode flag is reset to "0" at step S14.

A subroutine for setting sorter mode is executed at step S15. A subroutine for setting finishing mode is executed at step S16, and at step S17, whether the sorting mode flag is "1" or not is checked. When the sorting mode flag is "0", the sorting and the stapling operations will not be executed, so that the processing goes to step S22. When the sorting mode flag is "1", the bin number (a) is inputted at step S18, and the set number (A) and the bin number (a) are compared at step S19. When the set number (A) is smaller than the bin number (a), the operation in the sorting mode is possible, and then whether the finishing mode flag is "1" or not is checked at step S20. When the finishing mode flag is "0", the processing goes to step S22, and when it is "1", whether the sheet size (Sx) is A4 size or B5 size is checked at step S21. As described above the sheet sizes allowed for stapling operation are A4 size and B5 size. When the result is "Yes", other input processing is executed at step S22, and when the result is "No", the processing goes to step S31.

Further, whether the print switch 121 is turned on or not is checked at step S23. When it is turned on, a copying flag is set to "1" at step S24 for enabling the copying operation. When it is not turned on, whether the ADF start switch 141 is turned on or not is checked at step S25. When it is turned on, the processing at said step S24 is executed, and when it is not turned on, the subroutine is terminated.

On the other hand, when the set number (A) is judged to be larger than the bin number (a) at said step S19, an alarm flag F1 is set to "1" at step S26, and the operation of the system is inhibited at step S27. The alarm flag F1 is for indicating that the number for distribution has exceeded the number of the bins 60. At steps S28 and S36, whether the print switch 121 and the ADF start switch 141 are turned on respectively are checked in the same manner as that at said steps S23 and S25. When the result is "Yes", that is, when the operator's will for executing the copying operation regardless of the alarm signal is confirmed, a non-sorting mode flag is set to "1" at step S29, and the alarm flag F1 is reset to "0" at step S30. Then, the inhibition of system operation is canceled at step S30*a*, and the copYing flag is set to "1" at step S37.

Further, when the sheet size (Sx) is judged to be other than A4 size and B5 size at said steps S21 and S304, the stapling operation is not possible, so that an alarm flag F2 is set to "1" at step S31, and the operation of the system is inhibited at step S32. The alarm flag F2 is for indicating that the selected sheet size is wrong. Then, whether the print switch 121 and the ADF start switch 141 are turned on respectively are checked at steps S33 and S38 in the same manner as that at said steps S23 and S25. When the operator's will for executing the copying operation regardless of the alarm signal at step S33 or step S38 is confirmed, the finishing mode flag is reset to "0" at step S34, and the alarm flag F2 is reset to "0" at step S35. The inhibition of the system operation is canceled at step S35*a*, and the copying flag is set to "1" at step S39.

Figure 21:
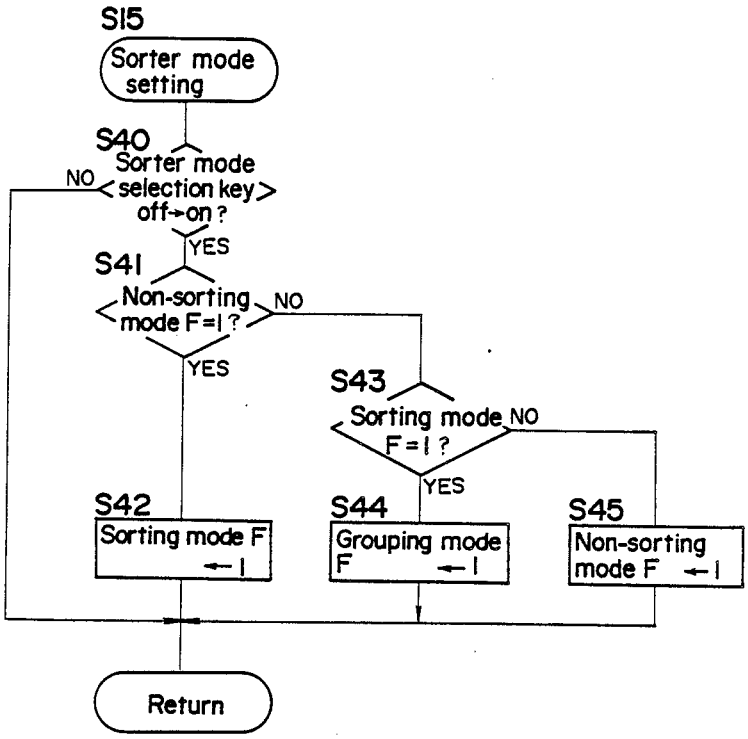
FIG. 21 is a flow chart showing a subroutine for the sorter mode setting.

FIG. 21 shows a subroutine for the sorter mode setting to be executed at said step 815.

In the subroutine, whether or not the sorter mode selection key 151 is changed to on from off is checked at step S40. When the result is "No", the subroutine is terminated at once. When the result is "Yes", at steps S41 and S43, whether or not the non sorting mode flag and the sorting mode flag are "1" are checked respectively. When the non-sorting mode flag is "1", the sorting mode flag is set to "1" at step S42. When the sorting mode flag is "1", a grouping mode flag is set to "1" at step S44. When both the non sorting mode flag and the sorting mode flag are "0", or at this time the grouping mode flag is "1", the non-sorting mode flag is set to "1" at step S45.

Figure 22:
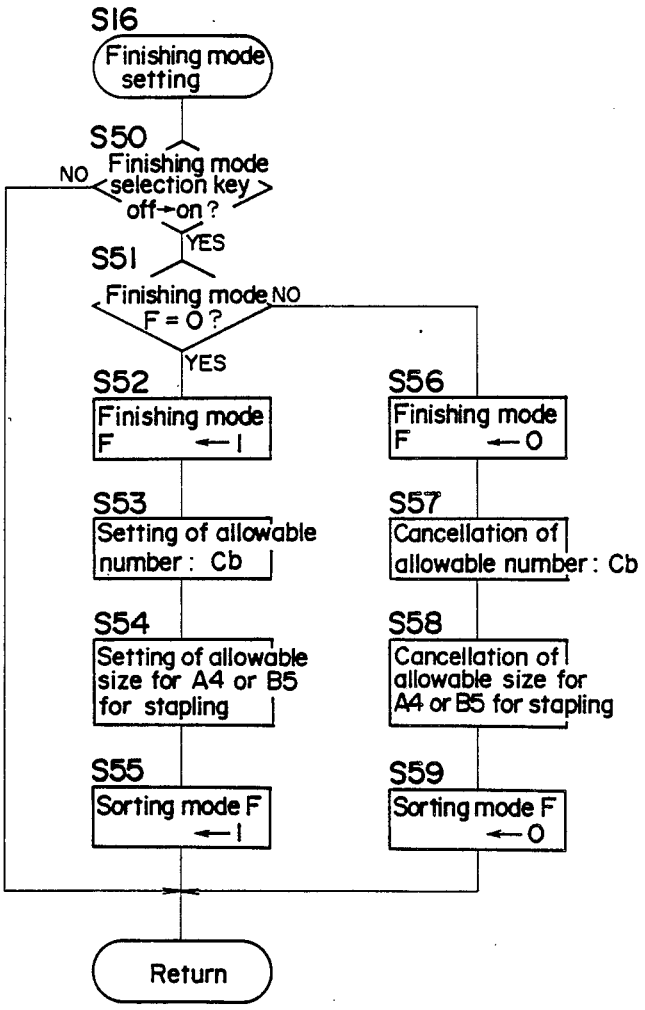
FIG. 22 is a flow chart showing a subroutine for the finishing mode setting.
Figure 23A:
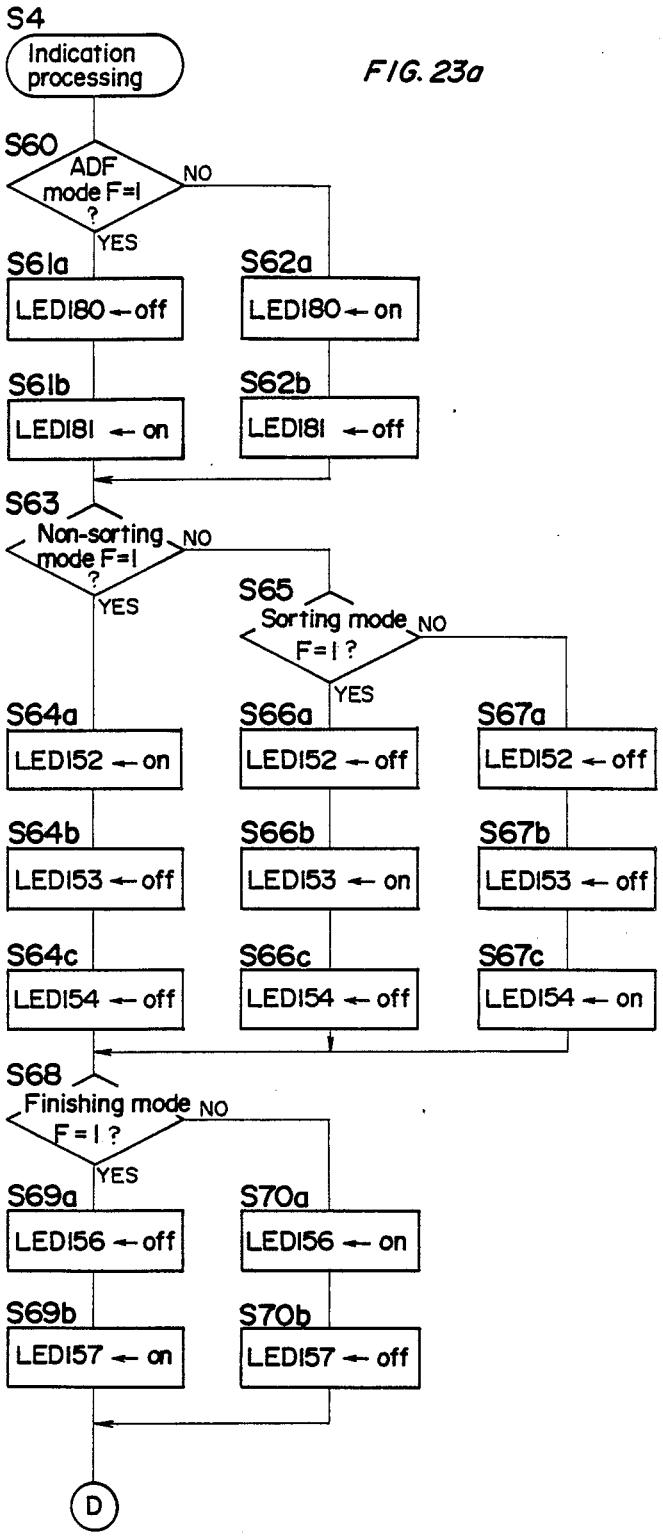
FIGS. 23*a*, 23*b*, 23*c* and 23*d* are flow charts showing a subroutine for the indication processing.
Figure 23B:
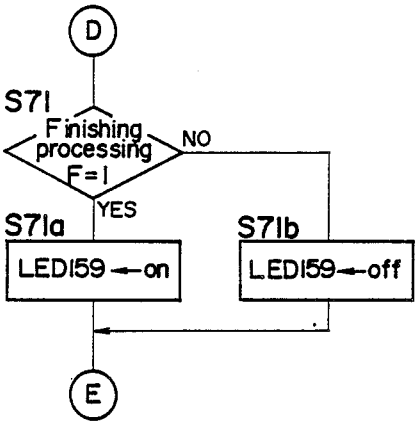
Figure 23C:
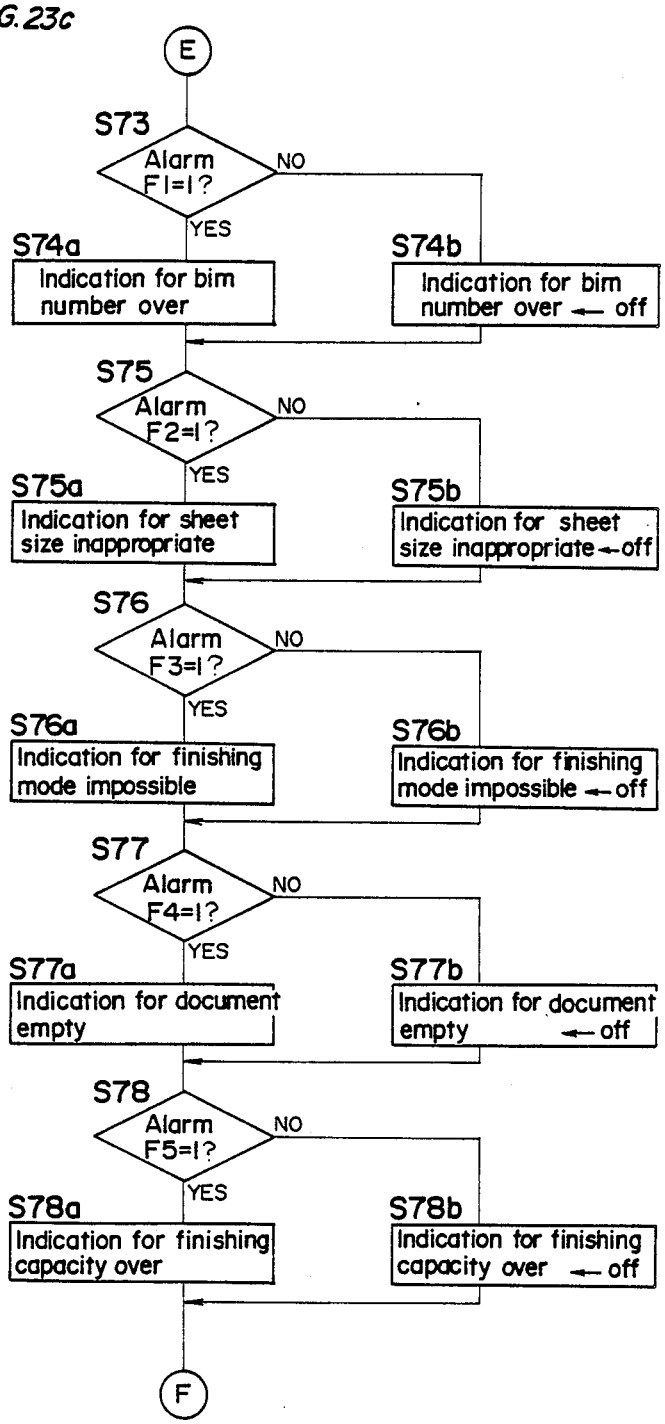
Figure 23D:
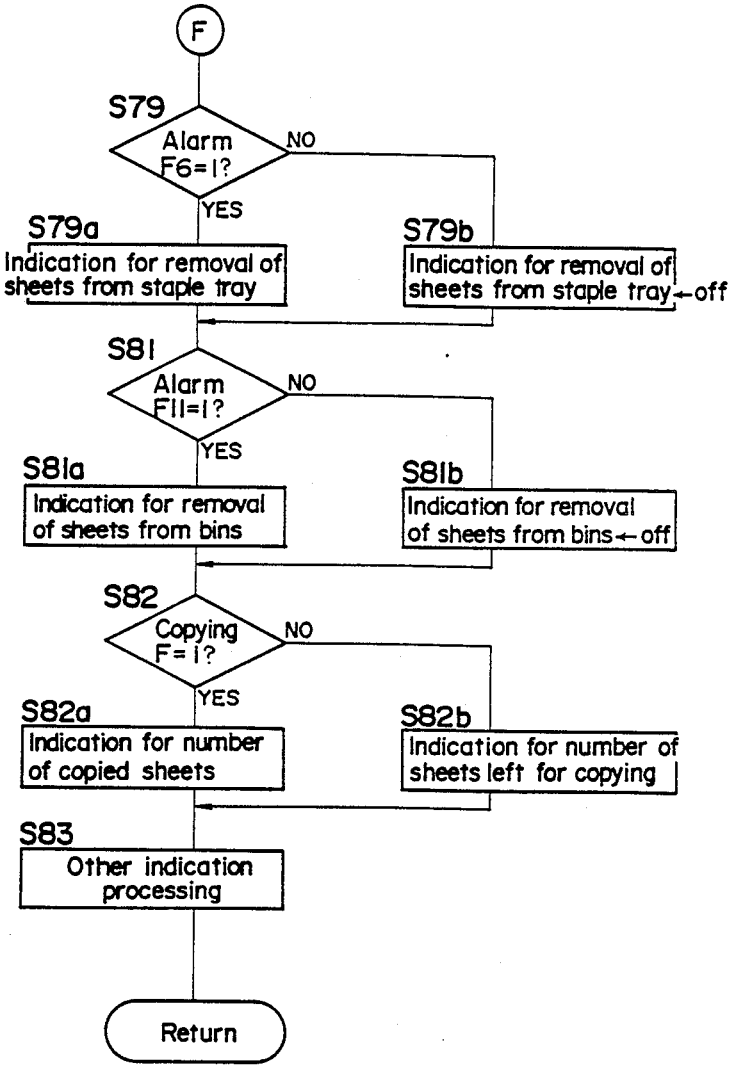

FIG. 22 shows a subroutine for the finishing mode setting to be executed at said step S16.

First, whether or not the finishing mode selection key 155 is changed to on from off is checked at step S50. When the result is "No", the subroutine is terminated at once. When the result is "Yes", at step S51, whether or not the finishing mode flag is "0" is checked. When the flag is "0", that means the finishing mode has not been selected, the finishing mode flag is set to "1" at step S52. Then, allowable stapling number (Cb) is set at step S53. The allowable sheet size for stapling is set to A4 and B5 at step S54. The sorting mode flag is set to "1" at step S55 for allowing the operation in the sorting mode.

On the other hand, at said step S51, when the finishing mode flag is judged to be "1", that means the finishing mode has been selected, the finishing mode flag is reset to "0" at step S56. Then, the setting of the allowable stapling number (Cb) is canceled at step S57. The allowable sheet size for stapling is canceled at step S58. The sorting mode flag is reset to "0" at step S59, and the operation in the sorting mode is inhibited.

FIGS. 23*a* through 23*d* show a subroutine for the indication processing to be executed at step S4 of the main routine.

First, whether the ADF mode flag is "1" or not is checked at step S60. When it is "1", the LED 180 for indicating the non-ADF mode is turned off at step S61*a*, and the LED 181 for indicating the ADF mode is turned on at step S61*b*. When the ADF mode flag is "0", the LED 180 is turned on at step S62*a*, and the LED 181 is turned off at step S62*b*.

Further, whether the non-sorting mode flag and the sorting mode flag are "1" or not is checked at steps S63 and S65 respectively. When the non-sorting mode flag is "1", the LED 152 for indicating the non-sorting mode is turned on at step S64*a*, and the LEDs 153 and 154 are turned off at steps S64*b* and S64*c*. When the sorting mode flag is "1", the LED 152 is turned off at step S66*a*, the LED 153 for indicating the sorting mode is turned on at step S66*b*, and the LED 154 is turned off at step S66*c*. When said two flags are "0", the LEDs 152 and 153 are turned off at steps S67*a* and S67*b*, and the LED 154 for indicating the grouping mode is turned on at step S67*c*.

Next, at step S68, whether the finishing mode flag is "1" or not is checked. When it is "1", the LED 156 for indicating the non-finishing mode is turned off at step S69*a*, and the LED 157 for indicating the finishing mode is turned on at step S69*b*. When the finishing mode flag is "0", the LED 156 is turned on at step S70*a*, and the LED 157 is turned off at step S70*b*. At step S71, whether the finishing processing flag is "1" or not is checked. The finishing processing is a series of processing that the sheets distributed into the bins 60 in the sorting unit 40 are ejected therefrom and transported onto the stapling tray 91 by the transport unit 80 and thereon stapled by the stapler 100 after the sheets alignment and finally stacked in the stack tray 111. The finishing processing flag is "1" while the series of processing as mentioned above is executed. Accordingly, when the finishing processing flag is "1", the LED 159 for indicating the finishing processing has started is turned on at step S71*a*. When it is "0", the LED 159 is turned off at step S71*b*.

Further, at step S73, the alarm flag F1 is checked whether "1" or not. When the flag F1 is "1", the indicator 125 indicates that the set number is larger than the bins number at step S74*a*. When the flag F1 is "0", the indication of an excess number of sets over that of bins on the indicator 125 is turned off at step S74*b*. At step S75, the alarm flag F2 is checked whether "1" or not. When the flag F2 is "1", the indicator 125 indicates that the sheet size is inappropriate at step S75*a*. When the flag F2 is "0", the indication of an inappropriate sheet size on the indicator 125 is turned off at step S75*b*. At step S76, the alarm flag F3 is checked whether "1" or not. When the flag F3 is "1", the indicator 125 indicates that the finishing mode is not available at step S76*a*. When the flag F3 is "0", the indication of unavailability of finishing mode on the indicator 125 is turned off at step S76*b*. At step S77, the alarm flag F4 is checked whether "1" or not. When the flag F4 is "1", the indicator 125 indicates that the document is absent at step S77*a*. When the flag F4 is "0", the indication of the absence of document on the indicator 125 is turned off at step S77*b*. At step S78, the alarm flag F5 is checked whether it is "1" or not. When the flag F5 is "1", the indicator 125 indicates that the number of sheets in each bin is over the finishing capacity at step S78*a*. When the flag F5 is "0", the indication of an excess number of sheets over the allowable stapling number on the indicator 125 is turned off at step S78*b*. At step S79, the alarm flag F6 is checked whether "1" or not. When the flag F6 is "1", the LED 159 is flickering at step S79*a* to indicate that the sheets need to be removed from the staple tray 91 When the flag F6 is "0", the LED 159 is turned off, so the indication for removal of the sheets from the staple tray 91 is turned off at step S79*b*. At step S81, the alarm flag F11 is checked whether "1" or not. When the flag F11 is "1", the LED 160 is turned on at step S81*a* to indicate that the sheets need to be removed from the bins 60. When the flag F11 is "0", the LED 160 is turned off, so the indication for removal of the sheets from the bins 60 is turned off at step S81*b*.

Further, whether the copying flag is "1" or not is checked at step S82. The indicator 125 indicates the number of copied sheets at step S82*a* when the copying flag is "1", and the number of sheets left for copying is indicated at step S82*b* when the flag is "0". Subsequently, other indication processing is executed at step S83, and this subroutine is completed.

Figure 24:
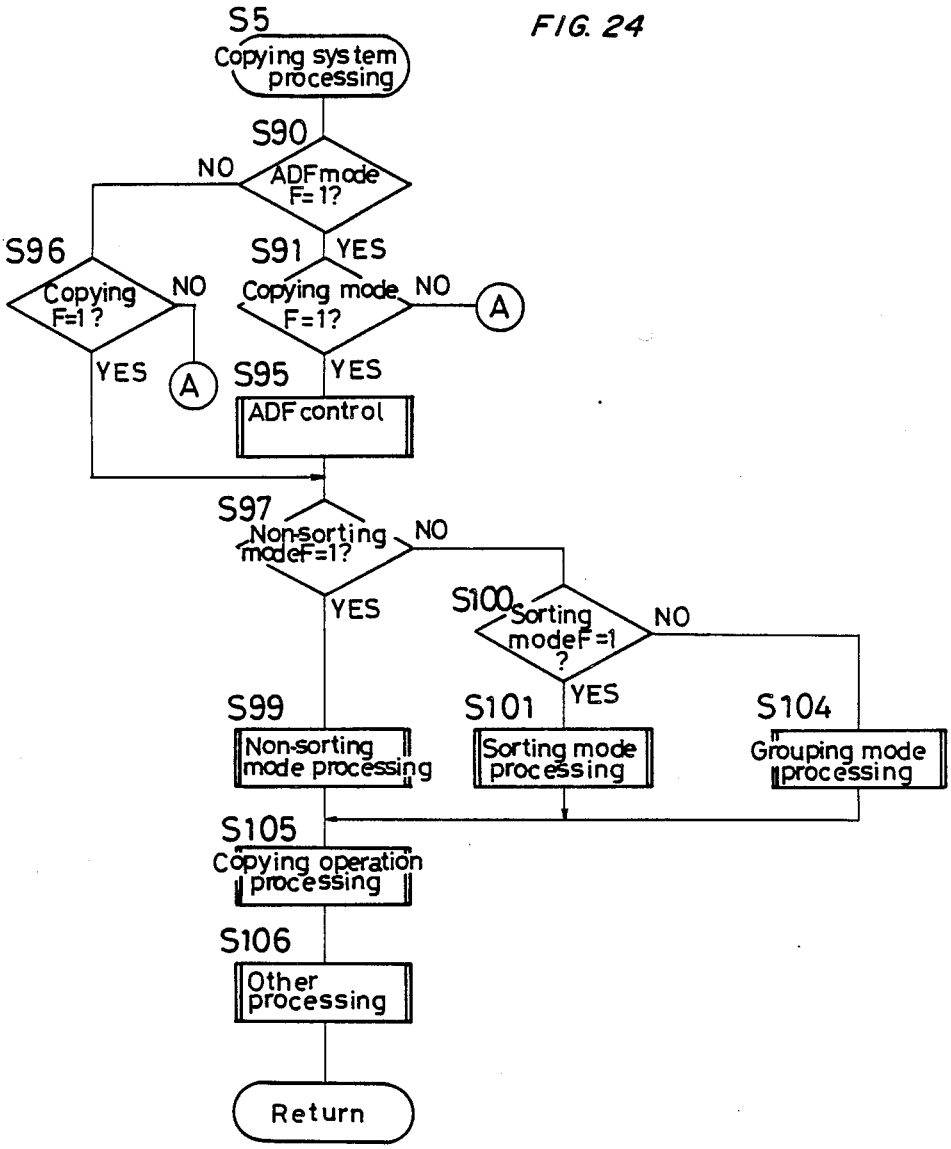
FIG. 24 is a flow chart showing a subroutine for the copying system processing.

FIG. 24 shows a subroutine for the processing of copying system to be executed at step S5 of the main routine.

First, whether the ADF mode flag is "1" or not is checked at step S90. When it is "1", whether the copying flag is "1" or not is checked at step S91. Since the copying operation is allowed when the copying flag is "1", a subroutine for the control of the ADF 30 is executed at step S95, and the processing goes to step S97. When the ADF mode flag is judged to be "0" at said step S90, whether the copying flag is "1" or not is checked at step S96. When it is "1", the processing goes to step S97. When the copying flag is judged to be "0" at said steps S91 and S96 respectively, the processing returns to the main routine.

When the non-sorting mode flag and the sorting mode flag are verified to be "1" at steps S97 and S100 respectively, subroutines for the non-sorting mode processing and sorting mode processing can be executed at steps S99 and S101 respectively. On the other hand, when the non-sorting mode flag and the sorting mode flag are verified to be "0" at said steps S97 and S100, a subroutine for the grouping mode processing can be executed at step S104. Further, a subroutine for the copying operation is executed at step S105, and a subroutine for other processing is executed at step S106.

The subroutines to be executed at said steps S99 and S104 can be executed by the procedures similar to the conventional ones, so that the details of these procedures are omitted here.

Figure 25:
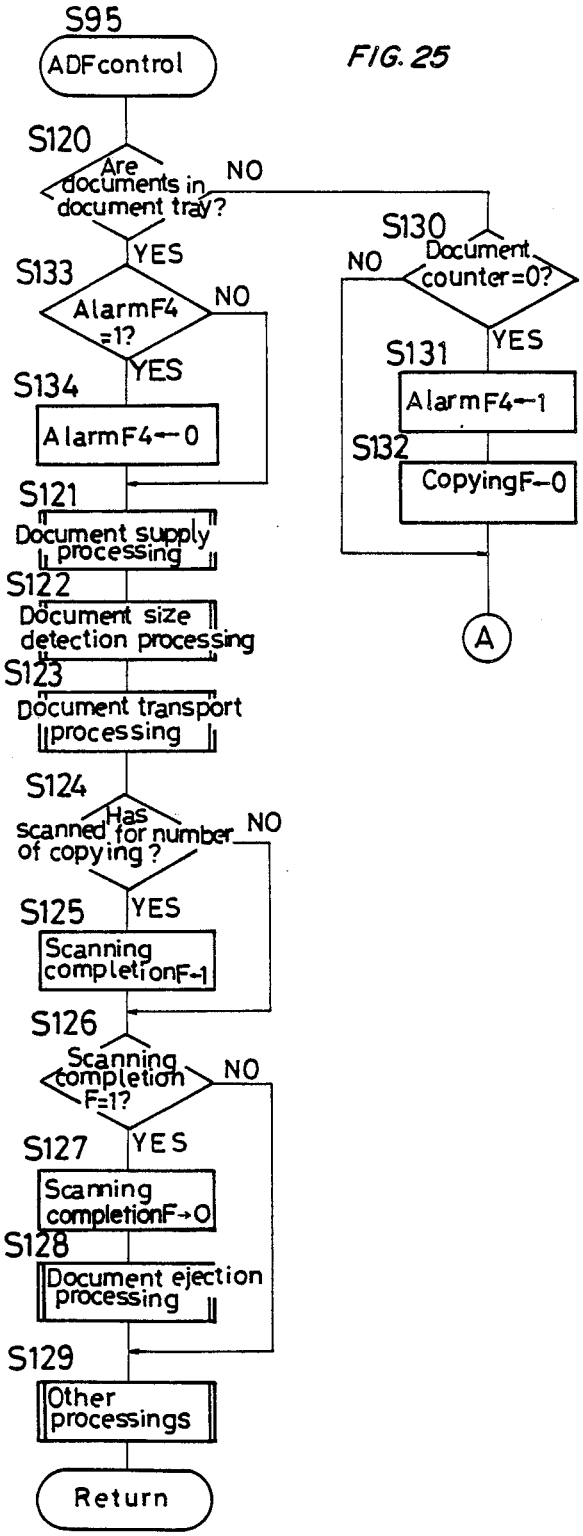
FIG. 25 is a flow chart showing a subroutine for the ADF control.

FIG. 25 shows a subroutine for the ADF control to be executed at said step S95.

First, whether the documents are present in document tray 31 or not is checked by on-off action of the sensor 37 at step S120. When the documents are present, whether the alarm flag F4 is "1" or not is checked at step S133. This flag F4 is set to "1" at step S131 which will be explained later, but when the flag F4 is "1", it is reset to "0" at step S134. Then, a document supply processing subroutine at step S121, a document size detection processing subroutine at step S122 and a document transport processing subroutine at step S123 are executed respectively. When the documents have run out, whether the document counter registers "0" or not is checked at step S130. When "0" is registered, the alarm flag F4 is set to "1" at step S131, the copying flag is reset to "0" at step S132, and the processing returns to the main routine.

On the other hand, at step S124, whether the optical system 4 has scanned each copy for several minutes or not is checked. When the result is "Yes", a scanning completion flag is set to "1" at step S125. Then, after it is confirmed at step S126 that the scanning completion flag is set to "1", the scanning completion flag is reset to "0" at step S127. A document ejection processing subroutine is executed at step S128. Subroutines for other processing are executed at step S129.

Further, the ADF control subroutine is similar to the conventional one, so that the details of the subroutines to be executed at said steps S121, S123 and S128 are omitted here.

Figure 26A:
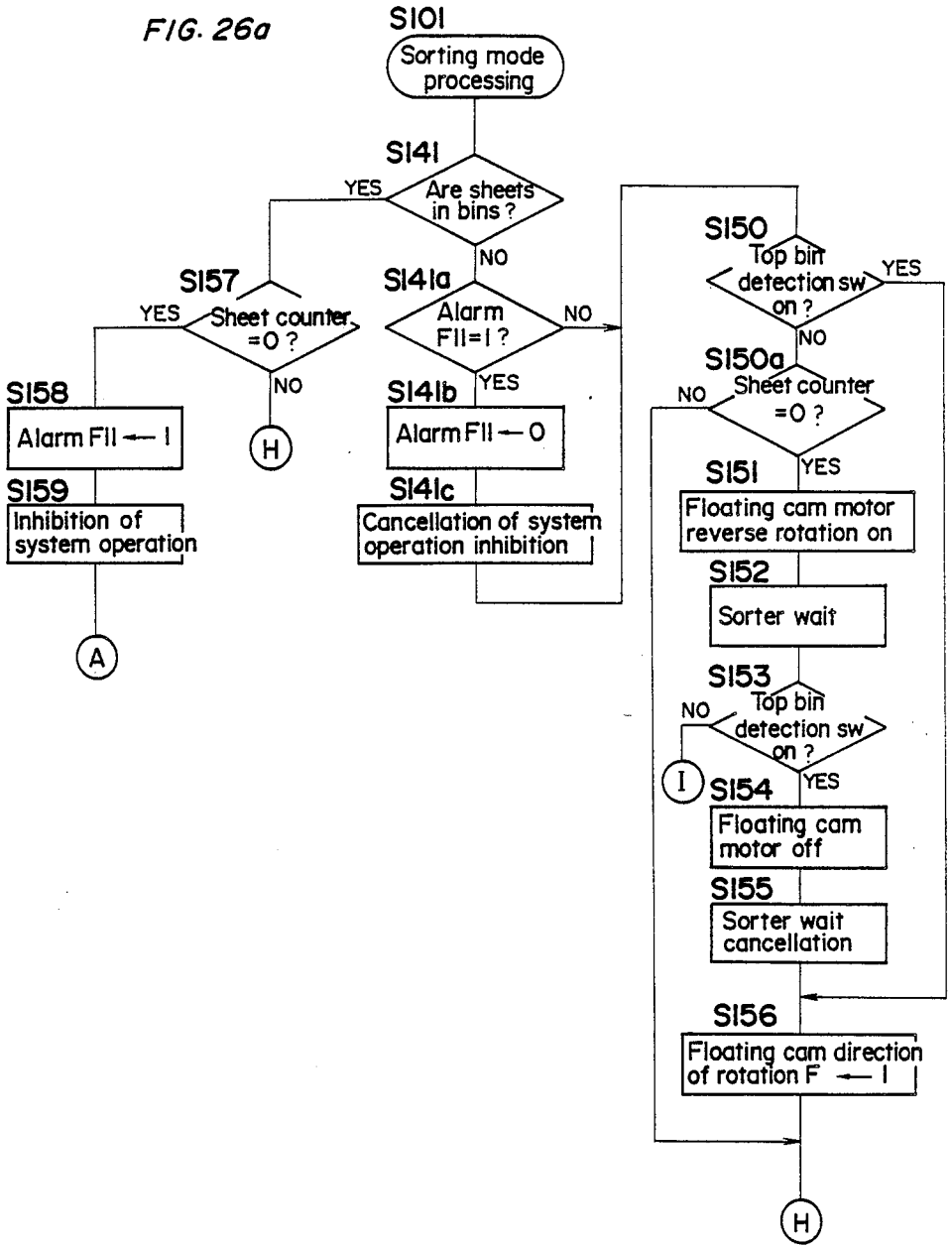
FIGS. 26*a*, 26*b* and 26*c* are flow charts showing a subroutine for the sorting mode processing.
Figure 26B:
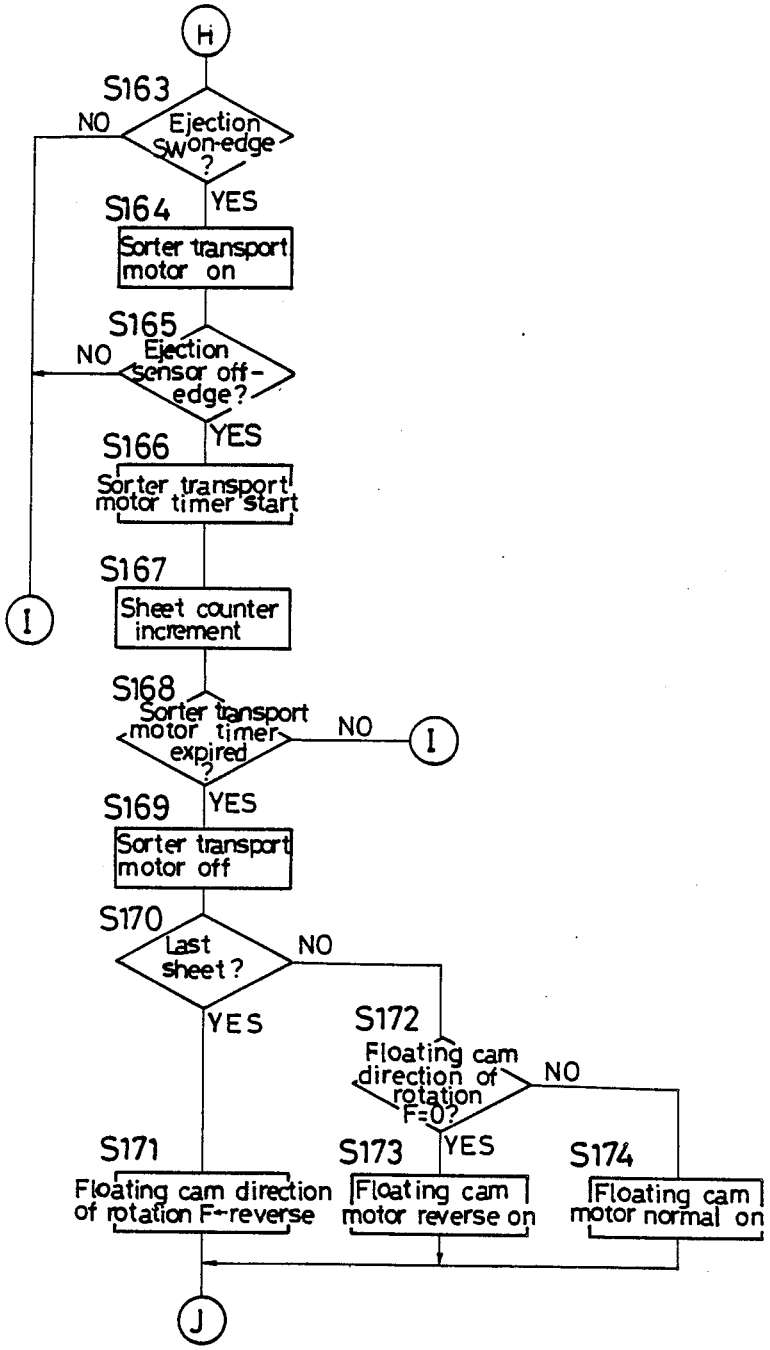
Figure 26C:
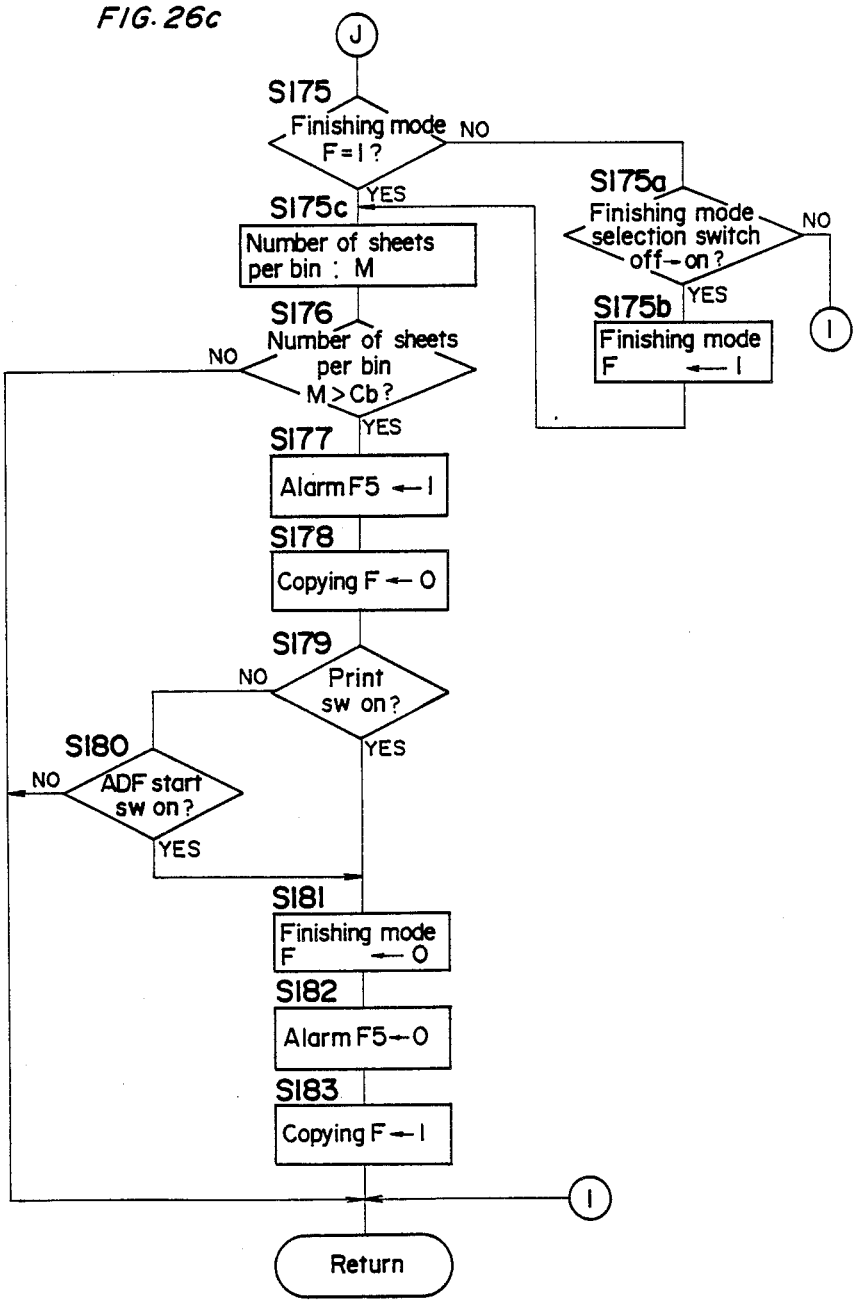

FIGS. 26*a* through 26*c* show a subroutine for the processing of sorting mode to be executed at said step S101. In this subroutine, the sheets are distributed among the bins 60 in order from the top to the bottom without regard to whether the finishing mode is selected or not. Accordingly, at the time of starting the sorting mode processing, each bin 60 is shifted to its home position, the top bin position X2.

More particularly, whether the sheets in the bins 60 are present or not is checked by the on-off signal of the sensor Se5 at step S141. When the sheets are absent, whether the alarm flag F11 is "1" or not is checked at step S141*a*. This alarm flag F11 is set to "1" at step S158 which will be explained later. When the alarm flag F11 is "1", it is reset to "0" at step S141*b*, and the Inhibition of system operation is canceled at step S141*c*. Then, whether the top bin detection switch 8W2 is turned on or not, that is, whether or not the bins 60 are at the top bin position X2 which is their home position at the time of the sorting mode operation so that the distribution of the sheets is possible is checked at step S160. Thus, when the result of the check is "Yes", the processing proceeds to step S156, and the direction-of-rotation flag for the floating cam 50 is set to "1" to permit the normal rotation of the floating cam 50 so as to permit the distributing operation. When said result is "No", after the confirmation at step S150*a* that the count of a sheet counter is "0", the series of processing at steps S151 through S155 is executed to shift the bins 60 to the top bin position X2. That is, the rotation of the floating cam 50 is reversed at step S151; the sorter wait, which means the inhibition of the copying operation so that sheets are not transported into the sorting unit 41 during the movement of the bins 60 toward the top bin position X2, is applied at step S152; it is confirmed at step S153 that the top bin detection switch SW2 is turned on; the motor of the floating cam 50 is turned off at step S154; and the sorter wait is canceled at step S155. The direction-of-rotation flag of the floating cam 50 is set to "1" at step S156 to let the floating cam 50 rotate in its normal direction from this step onward, and the processing goes to step S163. On the other hand, when the sheet counter does not register "0" at step S150*a*, that indicates that the copying operation is in progress, the processing immediately goes to step S163.

Further, when the presence of the sheets in the bins 60 is detected at said step S141, whether the sheet counter registers "0" or not is checked at step S157. When it is judged to be "0", the alarm flag F11 is set to "1" at step S158 in order to prepare for lighting LED 160 for indicating the need of the removal of the sheets. The system operation is inhibited at steps S159 and S162, and the processing returns to the main routine.

Next, at step S163, whether the ejection switch SW3 of the copying machine 1 is on-edge or not is checked. When the front end of a sheet has arrived to the ejection switch SW3, the sorter transport motor is turned on at step S164, and whether the sorter ejection sensor Se1 is off-edge or not is checked at step S165. More particularly, the sheet is judged to have distributed to the bin 60 when the rear end of the sheet has passed the ejection sensor Se1. When the ejection sensor Se1 is off-edge, the timer of the sorter transport motor is started at step S166. The number of sheets to be counted is increased at step S167. When it is confirmed at step S168 that the time set by the timer of the sorter transport motor has passed, the sorter transport motor is turned off at step S169. Subsequently, whether the latest transported sheet is the last sheet or not is checked at step 8170. When it is judged to be the last sheet, the direction-of-rotation flag of the floating cam 50 is reversed at step 8171. That is, when the direction-of-rotation flag of the floating cam 50 has been reset to "0", it is set to "1", and it is reset to "0" when it has been set to "1". When said sheet is not judged the last sheet at said step S170, the direction-of-rotation flag of the floating cam 50 is checked at step S172 in order to continue the distributing operation. When the flag is judged to be "0", the rotation of the floating cam motor is reversed at step S173, and when it is judged to be "1", the rotation of said motor is normalized at step S174. Accordingly, the sheets are distributed among the bins 60 reciprocally from the bottom to the top and from the top to the bottom.

Then, whether the finishing mode flag is "1" or not is checked at step S175. When it is "1", the processing goes to step **S175*c*, and when it is "0", that means the finishing mode is not selected, whether the finishing mode selection switch 155 is changed to on from off or not is checked at step S175*a*. When the switch 155 is not changed to on, that means the finishing mode is not selected, this subroutine is terminated. When the switch 155 is turned on, the CPU judges that the finishing mode has been selected at that time, the finishing mode flag is set to "1" at step S175*b*, and then the processing goes to step S175*c*. At step S175*c*, the number (M) of the sheets per bin is calculated, and the number (M) of the sheets per bin and the allowable number (Cb) of sheets for stapling (refer to step S53) are compared at step S176. When the number (M) of sheets per bin is larger than the allowable number (Cb) of sheets for stapling, the alarm flag F5 is set to "1" at step S177 in order to prevent the defective stapling, and the preparation is made for indicating that the number (M) of sheets is too large for the capacity of the stapling unit 90. The copying flag is reset to "0" at step S178. Whether the print switch 121 is turned on or not is checked at step S179. Whether the ADF start switch 141 is turned on or not is checked at step S180. When either the print switch 121 or the ADF start switch 141 is turned on, that is, when the operator's will for the execution of the copying operation regardless of the alarm is confirmed, the finishing mode flag is reset to "0" at step S181; the alarm flag F5 is reset to "0" at step S182; and the copying flag is set to "1" at step S183** for enabling the execution of the processing in the sorting mode so that this subroutine can be completed.

When the operator wants to terminate the copying operation and execute the finishing processing at the time of being given the alarm of the oversupply of the sheets during the execution of the processing at steps S176 and S177, the operator is required only to turn on the finish start switch 158 (refer to steps S210 and S207).

Figure 27:
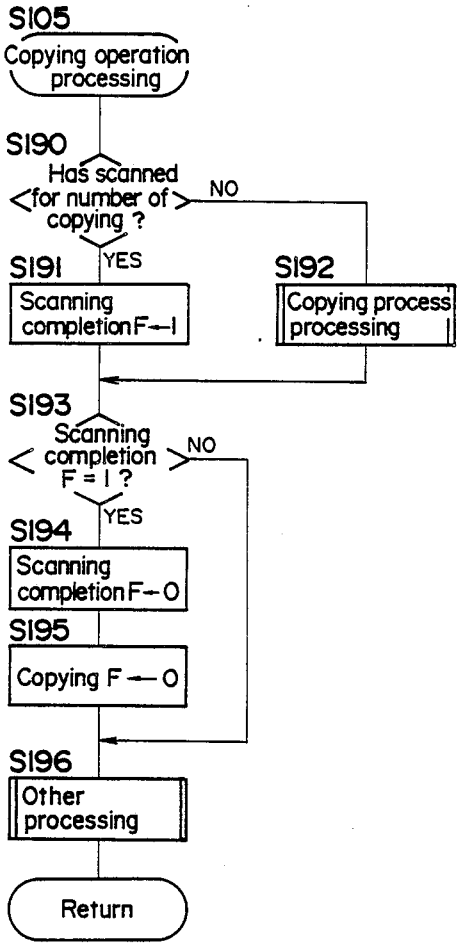
FIG. 27 is a flow chart showing a subroutine for the copying operation processing.
Figure 28A:
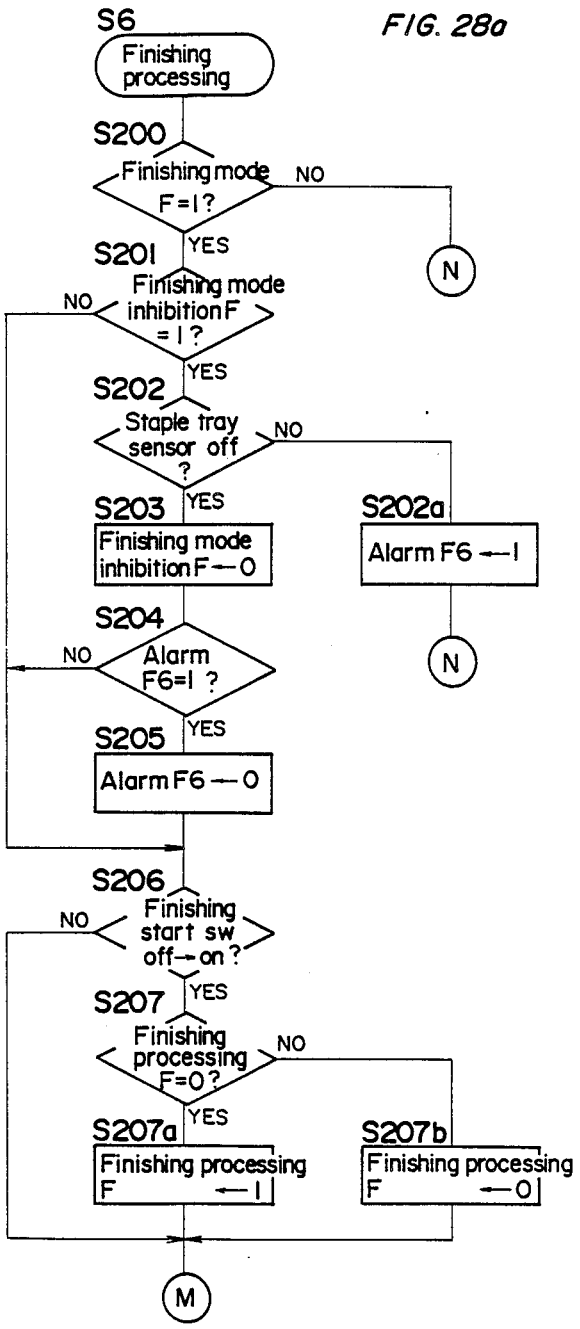
FIGS. 28*a* and 28*b* are flow charts showing a subroutine for the finishing processing.
Figure 28B:
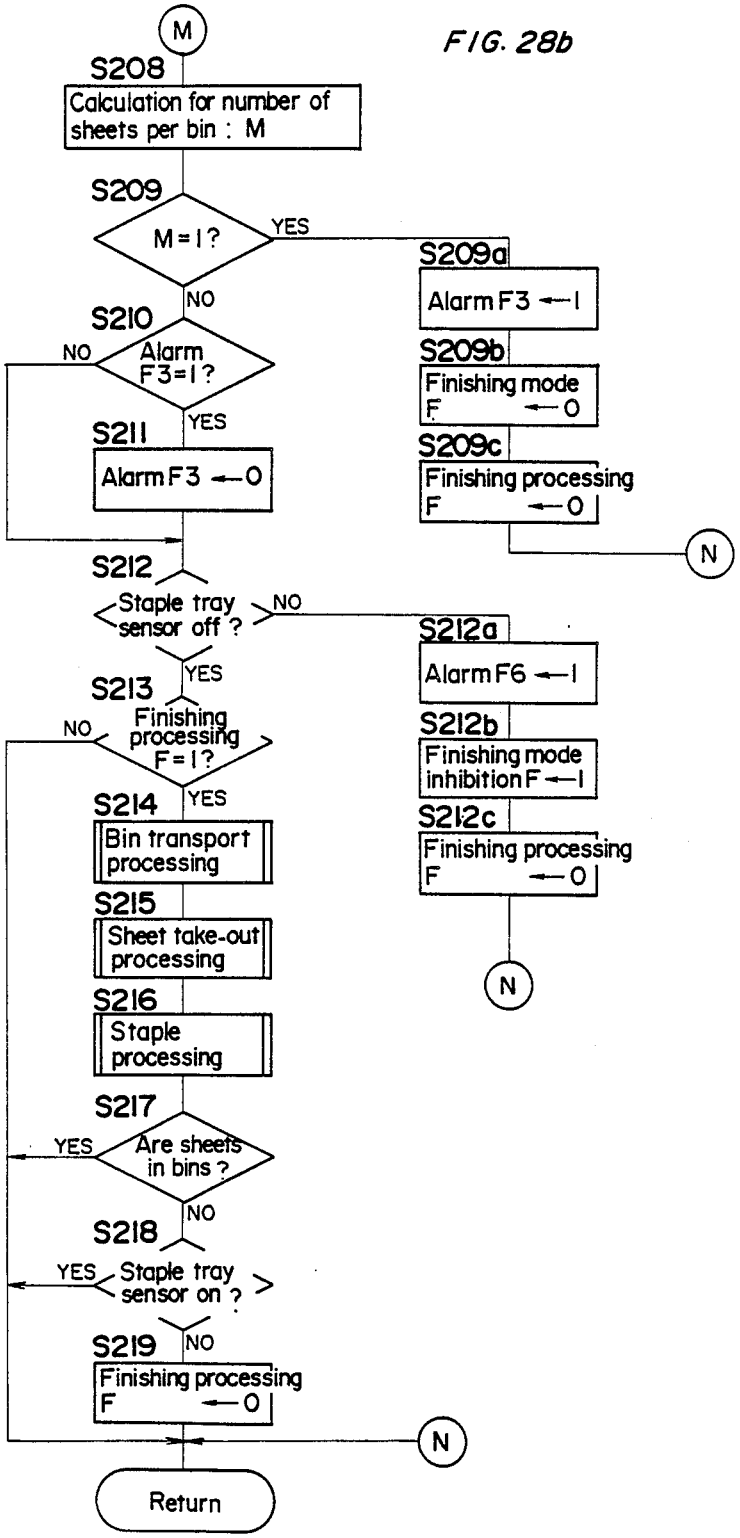

FIG. 27 shows a subroutine for the copying operation processing to be executed at said step S105.

First, whether the optical system 4 has scanned each copy for several minutes or not is checked at step S190. When this result is "Yes", the scanning completion flag is set to "1" at step S191. When the result is "No", a subroutine for the processing of copying process is executed at step S192. This subroutine is designed for the execution of the ordinary copy process by the copying machine 1. The details of this subroutine are omitted here.

Then, after confirming that the scanning completion flag is "1" at step S193, the scanning completion flag is reset to "0" at step S194; the copying flag is reset to "0" at step S195; and a subroutine for other processing is executed at step S196.

FIGS. **28*a* and 28*b* show a subroutine for the finishing processing to be executed at step S6** of the main routine.

First, whether the finishing mode flag is "1" or not is checked at step S200. When it is "0", the processing is terminated at once. When it is "1", whether a finishing mode inhibition flag is "1"or not is checked at step S201. When it is "0", the processing goes to step S206. When it is "1", whether the sheets on the staple tray 91 are present or absent is checked by the on-off signal of the sheet detection sensor Se6 on the staple tray 91 at step S202. When the sheets detection sensor Se6 is on, that means the sheets on the tray 91 are present, the alarm flag F6 is set to "1" at step **S202*a* in order to prepare for indicating the necessity of removing the sheets from the staple tray 91 so that the troubles such as the mixing and stapling of the sheets already stacked on the staple tray 91 together with the sheets transported later onto the staple tray 91 and the excessive supply of the sheets over the capacity of stapling unit 90** can be prevented.

On the other hand, when it is confirmed at step S202 that the sheets are not present on the staple tray 91, the finishing mode inhibition flag is reset to "0" at step S203 in order to cancel the inhibition of the finishing mode operation. Next, whether the alarm flag F6 is "1" or not is checked at step S204. When it is "1", the flag F6 is reset to "0" at step S205.

Next, whether the finishing start switch 158 is changed to on from off or not is checked at step S206. When the switch 158 is changed to on, whether the finishing processing flag is "0" or not is checked at step S207. When the finishing processing flag is "0", that is, the switch 158 has been turned on to select the finishing mode, the finishing processing flag is set to "1" to execute the finishing operation at step **S207*a*, and the processing goes to step S208. When the flag is "1", that is, the finishing mode has been currently selected, the finishing processing flag is reset to "0" at step S207*b*, and the processing goes to step S208**.

At step S208, the number (M) of sheets per bin is calculated. At step S209, whether the number (M) of sheets is "1" or not is checked. More particularly, when only one sheet is distributed into each of the bins 60, there is no need of stapling operation. Thus, when the number (M) of sheets per bin is found to be "1" at said step S209, the alarm flag F3 is set to "1" at step S209*a* in order to prepare for indicating that the finishing mode is impossible. Simultaneously, the finishing mode flag and the finishing processing flag are reset to "0" at steps S209*b* and S209*c* to cancel the finishing mode, and the subroutine is terminated. On the other hand, when it is confirmed that the number (M) of sheets per bin is not "1", whether the alarm flag F3 is "1" or not is checked at step S210. When the flag F3 is "1", the flag F3 is reset to "0" at step S211. Further, at step S212, whether the sheets on the staple tray 91 are present or absent is checked again by the on-off signal of the sensor Se6. When the sheets are present, the processing at steps 8212*a*, S212*b* and S212*c* are executed not only for giving an alarm but also for canceling the finishing mode in order to prevent such troubles as unnecessary stapling and defective stapling as described previously. That is, the alarm flag F6 is set to "1" at step S212*a*; the finishing mode inhibition flag is set to "1" at step S212*b*; the finishing processing flag is reset to "0"; and the subroutine is terminated.

When the sheets are absent on the staple tray 91, at step S213, it is checked whether the finishing processing flag is "1" or not, and when the flag is "0", the subroutine is terminated. When the flag is "1", the finishing processing is executed first. That is, a subroutine for the bin transport processing at step S214, a subroutine for the sheet take-out processing at step S215 and a subroutine for the staple processing at step S216 are respectively executed. Then, when the series of processing has been completed, the presence or absence of the sheets in each of the bins 60 is checked at step S217, and the presence or absence of the sheets on the staple tray 91 is checked at step S218. When both the sheets are absent, the finishing processing flag is reset to "0" at step S219.

Further, in the case of the finishing processing subroutine, it is confirmed at step S202 that the sheets have been removed from the staple tray 91 and then the alarm flag F6 is reset to "0" at step S205 so that the inhibition of the finishing mode is canceled. The finishing processing is resumed by the input with the finishing start switch 158 after canceling the inhibition of the finishing mode, and also an automatic resumption of the processing is possible by using a timer.

Figure 29:
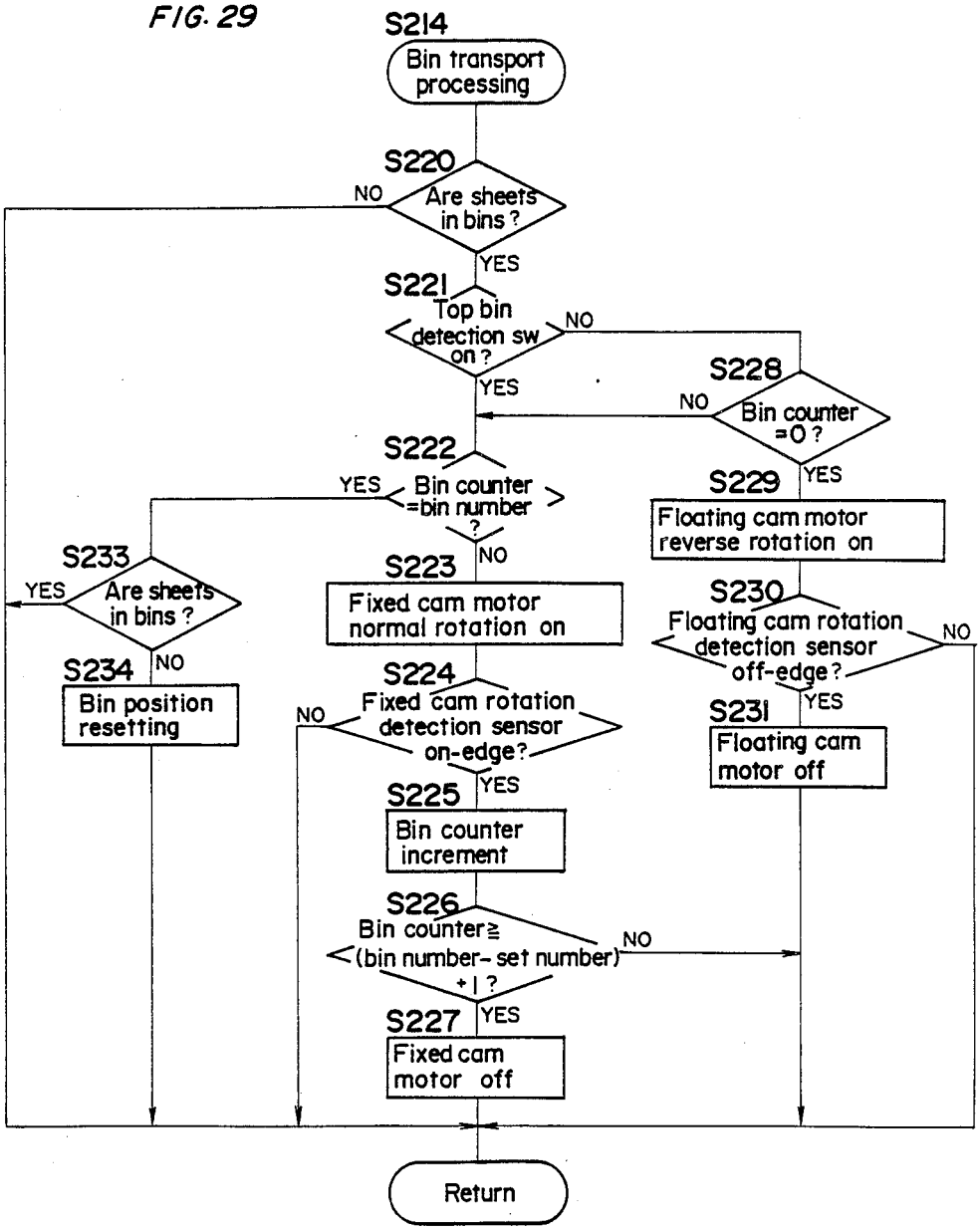
FIG. 29 is a flow chart showing a subroutine for the bin transport processing.

FIG. 29 shows a subroutine for the bin transport processing to be executed at said step S214.

First, the presence or absence of the sheets in the bins 60 is checked by the on-off signal of the sensor Se5 at step S220. When the sheets are absent in the bins 60, the processing is terminated at once. Actually, such a condition cannot occur unless the operator takes out the sheets from the bins 60 immediately after completing the copying and sorting operation. When the sheets are present, whether the top bin detection switch SW2 is on or not is checked at step S221. When the switch SW2 is not on, whether the count of a bin counter is "0" or not is checked at step S228. Since the bin counter, which has increment at step S225 as described later, is in the initial state (the count is "0"), the motor of the floating cam 50 is reversed in order to shift the floating cam 50 to the top bin position X2 at step S229. When it is confirmed at step S230 that the sensor for detecting the rotation of the floating cam 50 is off-edge, the motor of the floating cam 50 is turned off at step S231. These steps S229, S230 and S231 are repeated until the floating cam 50 reaches to the top bin position X2, so that the bins 60 are moved to the bottom bin position X1.

When the floating cam 50 is moved to the top bin position X2 and the bins are moved to the bottom bin position X2, that is, it is judged at step S221 that the top bin detection switch SW2 is on, at step S222, whether the bin counter registers the same as the number as the number (a) of the bins or not is checked. As the count of the bin counter is still "0" in this state, the fixed cam motor is turned in its normal direction at step S223, and whether the sensor Se2 for detecting the rotation of the fixed cam is on-edge or not is checked at steP S224. When it is on-edge, that means one of the bins 60 positioned at the bottom bin position X1 has been moved to the sheet take-out position X3, this causes the increment of the bin counter at step S225. Subsequently, whether the count of the bin counter is the number given by adding 1 to the subtraction of the set number (A) from the bin number (a) or not is checked at step S226. If the result is NO, these steps S224, S225 and S226 are repeated, and if the result is YES, the fixed cam motor is turned off at step S227. That is, each time one of bins 60 comes down to the sheet take-out position X3, the bin counter registers it, and until the count becomes equal to the number given by the calculation of adding 1 to the subtraction of the set number (A) from the bin number (a), that is, until the bottom bin of those which are used in the distributing operation is registered by the bin counter, the bins 60 are continuously moved down to the sheet take-out position X3. After that, with the execution of a subroutine for the sheet take-out processing at step S215 and a subroutine for the staple processing at step S216, the bins 60 wherein sheets are stacked are moved down to the sheet take-out position X3 one by one at intervals.

When it is judged at step S222 that the reading of the bin counter has become equal to the bin number (a), the stapling operation is completed, and a subroutine for resetting the bin position is executed at step S234 after confirming at step S233 that the sheets are not present in the bins 60.

Figure 30:
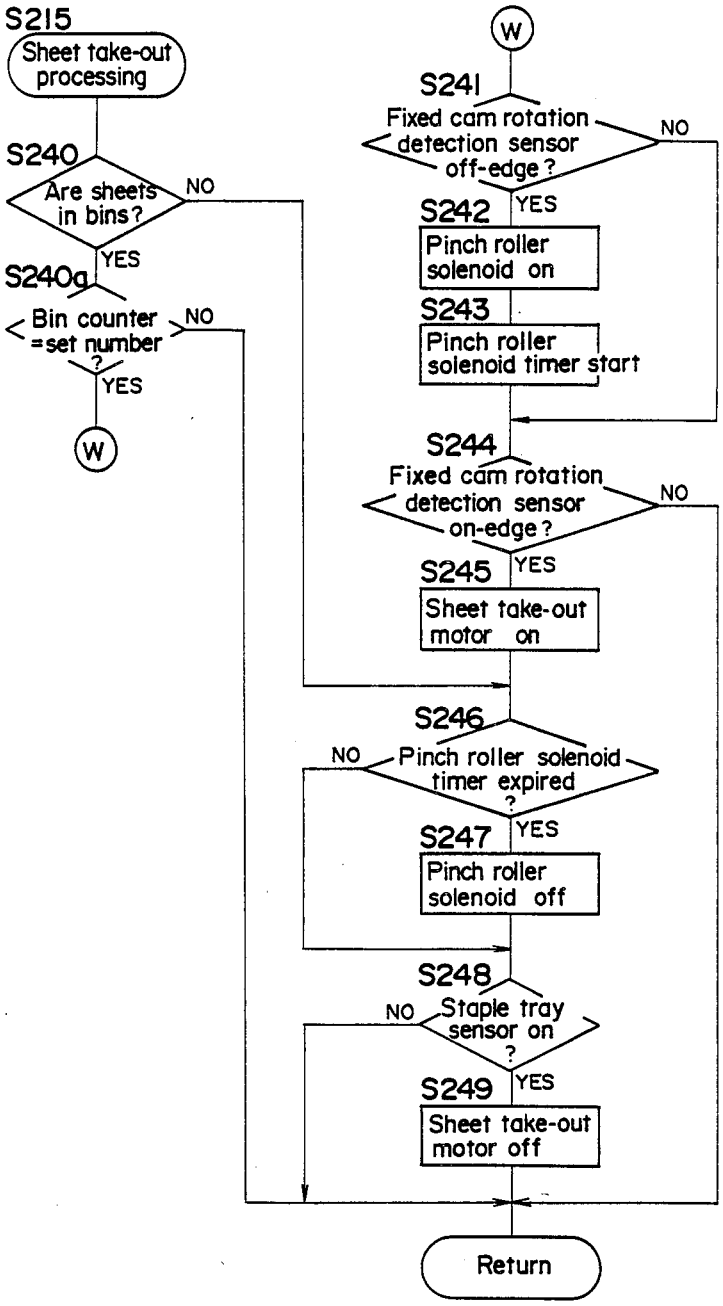
FIG. 30 is a flow chart showing a subroutine for the sheet take-out processing.

FIG. 30 shows a subroutine for the sheet take-out processing to be executed at said step S215. This subroutine is for the execution of the processing for transporting the sheets in the bins 60 which have been brought down to the sheet take-out position X3 therefrom to the staple tray 91 by the sheet transport unit 80.

First, whether the sheets are present or absent in the bin 60 which is coming down to the sheet take-out position X3 is checked by the on-off signal of the sensor Se5 at step S240. When the sheets are absent, an alarm is given by the system not shown in the flow charts, and the processing proceeds to step S246. When the presence of the sheet is confirmed, whether the reading of the bin counter is equal to, larger than or smaller than the set number (A) is checked at step S240*a*. That is, whether each bin 60 coming down to the sheets take-out position X3 has sheets therein or not is checked. If the reading of the bin counter is smaller than the set number (A), no sheets are stacked in the bin 60 coming to the sheet take-out position X3, and the processing immediately returns to the main routine. When the reading of the bin counter has become equal to the set number (A), the bins 60 thereafter coming to the sheet take-out position X3 have sheets therein. Accordingly, whether or not the fixed cam rotation detection sensor Se2 is off-edge, or whether the fixed cam 70 has started to turn in its normal direction or not is checked at step S241.

When it is found to be off-edge, or when the bin 60 has begun descent to the sheet take-out position X3, the solenoid of the pinch roller 76 is turned on at step S242, and the pinch roller solenoid timer is started at step S243. The sheets on the bin 60 is inserted between the take-out roller 75 and the pinch rollers 76 at the sheet take-out position X3 when the sheet is caused to come down as the fixed cam 70 turns in its normal direction.

Then, whether the fixed cam rotation detection sensor Se2 is on-edge or not, that is, whether the bin 60 has descended completely to the sheet take-out position X3 is checked at step S244. When it is found to be on-edge, the sheet take-out motor is turned on at step S245, and this causes the sheets to be transported to the staple tray 91 by the rollers 75, 76, 81*a* and 81*b*. When the expiration of the time set by the solenoid timer of pinch rollers 76 is confirmed at step S246, the pinch roller solenoid is turned off at step S247, as a result, the pinch rollers 76 withdraw upward away from the take-out roller 75. This is because the pinch rollers 76 need to move away from the sheet take-out position X3 before the next bin 60 starts to descend from the bottom bin position X1 so that the interference with the sheets distributed among the bins 60 can be prevented.

The supply of the sheets to the staple tray 91 is confirmed by sensor Se6, which turns on when the sheets are supplied, at step S248, and the sheet take-out motor is turned off at step S249 to terminate the execution of this subroutine.

Figure 31:
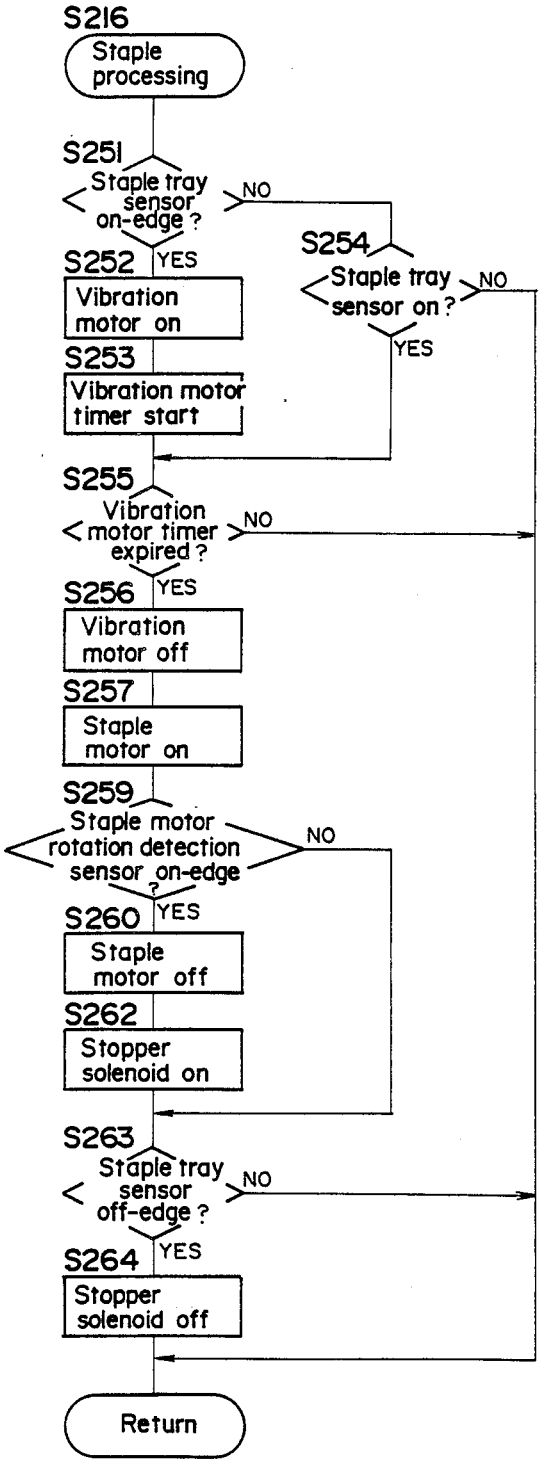
FIG. 31 is a flow chart showing a subroutine for the staple processing.

FIG. 31 shows a subroutine for the staple processing to be executed at said step S216.

First, whether the sensor Se6 of the staple tray 91 is on-edge or not is checked at step S251. This sensor Se6 is turned on when the sheets are supplied onto the tray 91. Thus, when said sensor Se6 is on-edge, the vibration motor 93 is turned on at step S252 in order to true up the sheets on the tray 91, and the timer of the vibration motor is started at step S253. On the other hand, when the sensor Se6 is not judged on-edge at step S251 and is judged on at step S254, that is, when the sheets are already placed on the tray 91, the processing goes to step S255.

After it is confirmed at step 8255 that the time set by the timer of the vibration motor has passed, the vibration motor is turned off at step S256, and the staple motor is turned on at step S257. When the staple motor sensor Se4 which detects the revolution of the staple motor is judged on-edge at step S259, that is, when the sheets are bound with the staple 106 following the movement of the head 105, the stapling motor is turned off at step S260, and the stopper solenoid is turned on at step S262. This causes the stopper 96 to withdraw from the tray 91, and the sheets slide down onto the stack tray 111.

Then, when the sensor Se6 of the staple tray 91 is judged off-edge at step S263, or when the ejection of the sheets into the stack tray 111 is detected, the stopper solenoid is turned off at step S264 to return the stopper 96 on the tray 981, and this subroutine is terminated.

Although the present invention has been described in connection with the preferred embodiments thereof, it is to be noted that various changes and modifications are apparent to those who are skilled in the art. Such changes and modifications are to be understood as included within the scope of the present invention as defined by the appended claims, unless they depart therefrom.

What is claimed is:

1. A sorter-finisher for distributing sheets ejected from an image forming device among a plurality of bins and thereafter stapling the distributed sheets, comprising:

a plurality of bins disposed one upon another and movable in the vertical direction independently from each other within a first area and a second area which are vertically adjacent to each other;

means for distributing sheets ejected from said image forming device among a specified sequence of said bins while said bins are moving within said first area, said sequence of distribution starting with the topmost bin and progressing toward the bottommost bin;

means for shifting said plurality of bins to said second area from said first area;

means for removing sheets from said bins which are shifted to said second area and stapling the sheets which are removed from said bins; and means for controlling the shifting of those bins in which sheets are not distributed to shift those bins to said second area continuously, without actuating said removing and stapling means, and thereafter controlling the shifting of the other bins in which sheets are distributed to shift those bins to said second area one by one and to actuate said stapling means.

2. A method of operating a sorter-finisher for distributing sheets ejected from an image forming device among a plurality of bins and thereafter stapling the distributed sheets, comprising the following steps:

distributing sheets ejected from said image forming device among a specified sequence of said bins while said bins are moving within a first area, said sequence of distribution starting with the topmost bins and progressing toward the bottommost;

continuously shifting some of said bins among which sheets are not distrusted to a second area from said first area without actuating a stapling means; and thereafter shifting the other bins among which sheets are distributed to said second area by one with the operation of said stapling means.

3. A sorter-finisher for distributing sheets ejected from an image forming device among a plurality of bins and thereafter stapling the distributed sheets, comprising:

means for selecting a finishing mode which allows an operation of a stapling means after an operation of a distributing means;

first control means for starting an operation of said stapling means in response to the order to execute a finishing operation when the finishing mode is selected; and second control means for allowing an operation of said mode selecting means before a distributing process and in the middle of said distributing process.

4. A sorter-finisher as claimed in claim 3 which comprises:

said second control means further allowing an operation of said mode selecting means after said distributing process.

* * * * *